US006220925B1

(12) United States Patent
Saito et al.

(10) Patent No.: US 6,220,925 B1
(45) Date of Patent: Apr. 24, 2001

(54) SILVER HALIDE COLOR PHOTOGRAPHIC LIGHT-SENSITIVE MATERIAL

(75) Inventors: Naoki Saito; Hisashi Mikoshiba; Masakazu Morigaki; Shin Soejima; Yasuhiro Yoshioka; Osamu Takahashi, all of Minami Ashigara (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/088,371

(22) Filed: Jun. 2, 1998

(30) Foreign Application Priority Data

Jun. 2, 1997 (JP) ..... 9-144168

(51) Int. Cl.[7] ..... G03C 7/32; G03C 7/388; G03C 7/392

(52) U.S. Cl. ..... 450/546; 430/548; 430/549; 430/557; 430/558

(58) Field of Search ..... 430/551, 546, 430/548, 549, 558

(56) References Cited

U.S. PATENT DOCUMENTS

| | | | | |
|---|---|---|---|---|
| 4,774,166 | * | 9/1988 | Saskai et al. | 430/376 |
| 5,378,596 | * | 1/1995 | Naruse et al. | 430/549 |
| 5,466,569 | * | 11/1995 | Weber et al. | 430/551 |
| 5,573,898 | * | 11/1996 | Sakai | 430/503 |
| 5,866,313 | * | 2/1999 | Hirano | 430/551 |

FOREIGN PATENT DOCUMENTS

| | | | |
|---|---|---|---|
| 59-204041A | | 11/1984 | (JP) . |
| 2-43540 | * | 2/1990 | (JP) . |
| 243540A | | 2/1990 | (JP) . |
| 2100048A | | 4/1990 | (JP) . |
| 7270990A | | 10/1995 | (JP) . |
| 9-288336 | * | 4/1997 | (JP) . |

* cited by examiner

*Primary Examiner*—Hoa Van Le
*Assistant Examiner*—Amanda C. Walke
(74) *Attorney, Agent, or Firm*—Birch, Stewart, Kolasch & Birch, LLP

(57) ABSTRACT

A silver halide color photographic light-sensitive material comprising a support having provided thereon at least one hydrophilic colloid layer, wherein the silver halide color photographic light-sensitive material contains a coupler represented by the formula (1) shown below and a non-color forming colorless cyclic imide compound having a diffusion-resistant group:

(1)

wherein $R^1$ and $R^2$ each represents an alkyl group or an aryl group; $R^3$, $R^4$ and $R^5$ each represents a hydrogen atom, an alkyl group or an aryl group; Z represents a non-metallic atomic group necessary to form a saturated ring; $R^6$ represents a substituent; X represents a heterocyclic group, a substituted amino group or an aryl group and Y represents a hydrogen atom or a group capable of being released upon color development.

The silver halide color photographic light-sensitive material has an excellent color forming property to provide a color image of high maximum color density and good color reproducibility.

19 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material excellent in color reproducibility. More particularly, the present invention relates to a silver halide color photographic light-sensitive material containing both a pyrrolotriazole coupler and a non-color forming colorless cyclic imide having a diffusion-resistant group.

BACKGROUND OF THE INVENTION

When a silver halide color photographic light-sensitive material is exposed and subjected to color development, a coupler is reacted with an oxidation product of an aromatic primary amine developing agent to form a color image. In such a photographic system, color reproduction is performed by a subtractive color process and in order to reproduce blue, green and red colors, yellow, magenta and cyan color images which are in a complementary relation, respectively, are formed. Among them, in order to form a cyan color image, a phenolic or naphtholic coupler is generally employed. However, a dye formed from such a coupler has a undesirable absorption in a green light region. Thus, the coupler causes a serious problem in that color reproducibility of the photographic material is remarkably deteriorated and it has been desired to solve such a problem.

In order to solve the problem, heterocyclic compounds are proposed to use as couplers as described, for example, in U.S. Pat. Nos. 4,728,598 and 4,873,183 and European Patent 249453A2. However, these couplers have another serious problem in that the coupling activity thereof is poor. Pyrroloazoles are proposed in European Patent 491197A1 to solve these problems. Although these compounds are superior to conventional couplers in view of the coupling activity and hue, further improvement has been desired.

On the other hand, methods of using additives to solve the above-described problems have been investigated in addition to the studies on structures of couplers per se. For instance, there are a technique for controlling hue by adding amide compounds or phenols as described in U.S. Pat. No. 5,474,880, a technique for increasing color forming property by adding hydrogen-providing compounds having a hydrogen bond as described in JP-A-7-270990 (the term "JP-A" as used herein means an "unexamined published Japanese patent application"), and techniques for improving color reproducibility and color forming property by adding ureas and specific carboxylic acids as described in JP-A-6-258802 and JP-A-6-3782, respectively. However, the above-described problems have not yet been solved sufficiently according to these techniques. Therefore, investigations on the structure of pyrroloazole coupler, the incorporation of additive and a suitable combination thereof have still been made.

Particularly, a further technical development is necessary to sufficiently enjoy the characteristic of excellent hue of dyes formed from these couplers in photographic light-sensitive materials.

SUMMARY OF THE INVENTION

Therefore, an object of the present invention is to provide a silver halide color photographic light-sensitive material having improved color reproducibility and color forming property.

Another object of the present invention is to provide a silver halide color photographic light-sensitive material which has improved fastness and prevents from the formation of stain and fog.

Other objects of the present invention will become apparent from the following description and examples.

The present inventors have analyzed in greater detail the mechanism of color-forming reaction of a pyrrolotriazole coupler in a silver halide color photographic light-sensitive material in order to solve the above-described problems. As a result, it has been found that the degradation of color reproducibility and color forming property is caused by the formation of an undesirable colored substance during the color-forming reaction process. For the purpose of inhibiting the formation of colored substance, the inventors have made various investigations on structure of pyrrolotriazole couplers and additives which are employed together with the couplers and completed the present invention.

The above-described objects of the present invention are accomplished by a silver halide color photographic light-sensitive material comprising a support having provided thereon at least one hydrophilic colloid layer, wherein the silver halide color photographic light-sensitive material contains a coupler represented by the formula (1) shown below and a non-color forming colorless cyclic imide compound having a diffusion-resistant group:

(1)

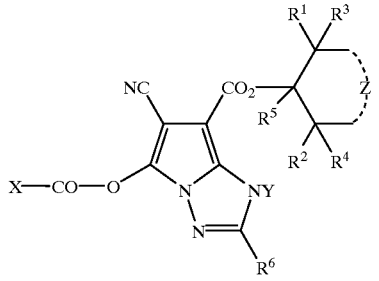

wherein $R^1$ and $R^2$ each represents an alkyl group or an aryl group; $R^3$, $R^4$ and $R^5$ each represents a hydrogen atom, an alkyl group or an aryl group; Z represents a non-metallic atomic group necessary to form a saturated ring; $R^6$ represents a substituent; X represents a heterocyclic group, a substituted amino group or an aryl group; and Y represents a hydrogen atom or a group capable of being released upon color development.

DETAILED DESCRIPTION OF THE INVENTION

Now, the coupler represented by the formula (1) which can be used in the present invention will be described in more detail below.

In the formula (1), the alkyl group represented by $R^1$, $R^2$, $R^3$, $R^4$ or $R^5$ is a straight chain, branched chain or cyclic alkyl group having from 1 to 36 carbon atoms, preferably a straight chain, branched chain or cyclic alkyl group having from 1 to 22 carbon atoms, and more preferably a straight chain or branched chain alkyl group having from 1 to 8 carbon atoms. Specific examples of the alkyl group include a methyl, ethyl, n-propyl, isopropyl, tert-butyl, tert-amyl, tert-octyl, decyl, dodecyl, cetyl, stearyl, cyclohexyl or 2-ethylhexyl group.

The aryl group represented by $R^1$, $R^2$, $R^3$, $R^4$ or $R^5$ in the formula (1) is an aryl group having from 6 to 20 carbon atoms, preferably an aryl group having from 6 to 14 carbon atoms, and more preferably an aryl group having from 6 to 10 carbon atoms. Specific examples of the aryl group include a phenyl, 1-naphthyl, 2-naphthyl or 2-phenanthryl group.

The non-metallic atomic group necessary to form a saturated ring represented by Z in the formula (1) is a non-metallic atomic group necessary to form a 5-membered to 8-membered saturated ring which may be substituted. A non-metallic atom for forming the ring include a carbon atom, an oxygen atom, a nitrogen atom and a sulfur atom. The ring is preferably a 6-membered saturated carbon ring, and more preferably a cyclohexane ring substituted with an alkyl group having from 1 to 24 carbon atoms on the 4-position thereof.

The substituent represented by $R^6$ in the formula (1) include, for example, a halogen atom (e.g., fluorine, chlorine, or bromine), an aliphatic group (preferably a straight chain or branched chain alkyl group having form 1 to 36 carbon atoms, an aralkyl group, an alkenyl group, an alkynyl group, a cycloalkyl group or a cycloalkenyl group, specifically, e.g., methyl, ethyl, propyl, isopropyl, tert-butyl, tridecyl, tert-amyl, tert-octyl, 2-methanesulfonyl-ethyl, 3-(3-pentadecylphenoxy)propyl, 3-{4-{2-[4-(4-hydroxyphenylsulfonyl)phenoxy]dodecanamido}phenyl}propyl, 2-ethoxytridecyl, trifluoromethyl, cyclopentyl, or 3-(2,4-di-tert-amylphenoxy)propyl), an aryl group (preferably having from 6 to 36 carbon atoms, specifically, e.g., phenyl, 4-tert-butylphenyl, 2,4-di-tert-amylphenyl, 4-tetradecanamidophenyl, or 2-methoxyphenyl), a heterocyclic group (preferably having from 1 to 36 carbon atoms, specifically, e.g., 2-furyl, 2-thienyl, 2-pyrimidinyl, or 2-benzothiazolyl), a cyano group, a hydroxy group, a nitro group, a carboxy group, an amino group, an alkoxy group (preferably a straight chain, branched chain or cyclic alkoxy group having from 1 to 36 carbon atoms, specifically, e.g., methoxy, ethoxy, butoxy, 2-methoxyethoxy, 2-dodecyloxyethoxy, or 2-methanesulfonylethoxy), an aryloxy group (preferably having from 6 to 36 carbon atoms, specifically, e.g., phenoxy, 2-methylphenoxy, 4-tert-butylphenoxy, 3-nitrophenoxy, 3-tert-butyloxycarbamoylphenoxy, or 3-methoxycarbamoylphenoxy), an acylamino group (preferably having from 2 to 36 carbon atoms, specifically, e.g., acetamido, benzamido, tetradecanamido, 2-(2,4-di-tert-amylphenoxy)butanamido, 4-(3-tert-butyl-4-hydroxyphenoxy)butanamido, or 2-[4-(4-hydroxyphenylsulfonyl)phenoxy]decanamido), an alkylamino group (preferably having from 1 to 36 carbon atoms, specifically, e.g., methylamino, butylamino, dodecylamino, diethylamino, or methylbutylamino), an arylamino group (preferably having from 6 to 36 carbon atoms, specifically, e.g., phenylamino, 2-chloroanilino, 2-chloro-5-tetradecanamidoanilino,2-chloro-5-dodecyloxycarbonylanilino, N-acetylanilino, or 2-chloro-5-[2-(3-tert-butyl-4-hydroxyphenoxy)dodecanamido]anilino), a ureido group (preferably having from 2 to 36 carbon atoms, specifically, e.g., phenylureido, methylureido, or N,N-dibutylureido), a sulfamoylamino group (preferably having from 1 to 36 carbon atoms, specifically, e.g., N,N-dipropylsulfamoylamino, or N-methyl-N-decylsulfamoylamino), an alkylthio group (preferably having form 1 to 36 carbon atoms, specifically, e.g., methylthio, octylthio, tetradecylthio, 2-phenoxyethylthio, 3-phenoxypropylthio, or 3-(4-tert-butylphenoxy)propylthio), an arylthio group (preferably having form 6 to 36 carbon atoms, specifically, e.g., phenylthio, 2-butoxy-5-tert-octylphenylthio, 3-pentadecylphenylthio, 2-carboxyphenylthio, or 4-tetradecanamidophenylthio), an alkoxycarbonylamino group (preferably having from 2 to 36 carbon atoms, specifically, e.g., methoxycarbonylamino, or tetradecyloxycarbonylamino), a sulfonamido group (preferably an alkyl- or aryl-sulfonamido group having from 1 to 36 carbon atoms, specifically, e.g., methanesulfonamido, butanesulfonamido, octanesulfonamido, hexadecanesulfonamido, benzenesulfonamido, p-toluenesulfonamido, octadecanesulfonamido, or 2-methoxy-5-tert-butylbenzenesulfonamido), a carbamoyl group (preferably having from 1 to 36 carbon atoms, e.g., N-ethylcarbamoyl, N,N-dibutylcarbamoyl, N-(2-dodecyloxyethyl)carbamoyl, N-methyl-N-dodecylcarbamoyl, or N-[3-(2,4-di-tert-amylphenoxy)propyl]-3-carbamoyl), a sulfamoyl group (preferably having from 1 to 36 carbon atoms, specifically, e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a sulfonyl group (preferably an alkyl- or aryl-sulfonyl group having from 1 to 36 carbon atoms, specifically, e.g., methanesulfonyl, octanesulfonyl, benzenesulfonyl, or toluenesulfonyl), an alkoxycarbonyl group (preferably having from 2 to 36 carbon atoms, specifically, e.g., methoxycarbonyl, butoxycarbonyl, dodecyloxycarbonyl, or octadecyloxycarbonyl), a heterocyclic-oxy group (preferably having from 1 to 36 carbon atoms, specifically, e.g., 1-phenyltetrazol-5-oxy, or 2-tetrahydropyranyloxy), an azo group (e.g., phenylazo, 4-methoxyphenylazo, 4-pivaloylaminophenylazo, or 2-hydroxy-4-propanoylphenylazo), an acyloxy group (preferably having from 2 to 36 carbon atoms, specifically, e.g., acetoxy), a carbamoyloxy group (preferably having from 1 to 36 carbon atoms, specifically, e.g., N-methylcarbamoyloxy, or N-phenylcarbamoyloxy), a silyloxy group (preferably having from 3 to 36 carbon atoms, specifically, e.g., trimethylsilyloxy, or dibutylmethylsilyloxy), an aryloxycarbonylamino group (preferably having from 7 to 36 carbon atoms, specifically, e.g., phenoxycarbonylamino), an imido group (preferably having from 4 to 36 carbon atoms, specifically, e.g., N-succinimido, N-phthalimido, or 3-octadecenylsuccinimido), a heterocyclicthio group (preferably having from 1 to 36 carbon atoms specifically, e.g., 2-benzothiazolylthio, 2,4-di-phenoxy-1,3,5-triazol-6-thio, or 2-pyridylthio), a sulfinyl group (preferably having from 1 to 36 carbon atoms, specifically e.g., dodecanesulfinyl, 3-pentadecylphenylsulfinyl, or 3-phenoxypropylsulfinyl), an alkyl-, aryl- or heterocyclicoxycarbonyl group (e.g., methoxycarbonyl, butoxycarbonyl, dodecyloxycarbonyl, octadecyloxycarbonyl, phenyloxycarbonyl, 2-pentadecyloxycarbonyl), an alkyl-, aryl- or heterocyclicoxycarbonylamino group (e.g., methoxycarbonylamino tetradecyloxycarbonylamino, phenoxycarbonylamino, or 2,4-di-tert-butylphenoxycarbonylamino), a sulfonamido group (e.g., methanesulfonamido, hexadecanesulfonamido, benzenesulfonamido, p-toluenesulfonamido, octadecanasulfonamido, or 2-methoxy-5-tert-butylbenzenesulfonamido), a carbamoyl group (e.g., N-ethylcarbamoyl, N,N-dibutylcarbamoyl, N-(2-dodecyloxyethyl)carbamoyl, N-methyl-N-dodecylcarbamoyl, or N-[3-(2,4-di-tert-amylphenoxy)propyl]carbamoyl), a sulfamoyl group (e.g., N-ethylsulfamoyl, N,N-dipropylsulfamoyl, N-(2-dodecyloxyethyl)sulfamoyl, N-ethyl-N-dodecylsulfamoyl, or N,N-diethylsulfamoyl), a phosphonyl group (e.g., phenoxyphosphonyl, octyloxyphosphonyl, or phenylphosphonyl), an imido group (e.g., N-succinimido, hydantoinyl, N-phthalimido, or 3-octadecenylsuccinimido), an azolyl group (e.g., imidazolyl, pyrazolyl, 3-chloropyrazol-1-yl, or triazolyl), a sulfo group, and an unsubstituted amino group.

$R^6$ is preferably an alkyl group, an aryl group, a heterocyclic group, a cyano group, a nitro group, an acylamino group, an arylamino group, a ureido group, a sulfamoylamino group, an alkylthio group, an arylthio group, an alkoxycarbonylamino group, a sulfonamido group, a carbamoyl group, a sulfamoyl group, a sulfonyl group, an alkoxycarbonyl group, an aryloxycarbonyl group, a heterocyclicoxy group, an acyloxy group, a carbamoyloxy group, an aryloxycarbonylamino group, an imido group, a heterocyclicthio group, a sulfinyl group, a phosphonyl group, an acyl group, or an azolyl group.

More preferably, $R^6$ is an alkyl group or an aryl group. Still more preferably, $R^6$ is an aryl group substituted at least with an alkyl group on the p-position thereof.

X represents a heterocyclic group, a substituted amino group or an aryl group as described above. A heterocyclic ring for forming the heterocyclic group represented by X is preferably a 5-membered to 8-membered ring containing a nitrogen atom, an oxygen atom or a sulfur atom as a hetero atom and having from 1 to 36 carbon atoms. A 5-membered or 6-membered nitrogen-containing heterocyclic ring which is connected to the carbonyl group through the nitrogen atom is more preferred. Among others, the 6-membered nitrogen-containing heterocyclic ring connecting through the nitrogen atom is particularly preferred.

Specific examples of the heterocyclic ring include imidazole, pyrazole, triazole, a lactam compound, piperidine, pyrrolidine, pyrrole, morpholine, pyrazolidine, thiazolidine and pyrazoline. Preferred rings are morpholine and piperidine, and morpholine is particularly preferred.

A substituent for the substituted amino group include an aliphatic group, an aryl group and a heterocyclic group. Suitable examples of the aliphatic group include those described for $R^6$ above. The aliphatic group may be substituted with a cyano group, an alkoxy group (e.g., methoxy), an alkoxycarbonyl group (e.g., ethoxycarbonyl), a chlorine atom, a hydroxy group or a carboxyl group. Of the substituted amino groups, a disubstituted amino group is more preferred than a monosubstituted amino group.

The aryl group has preferably from 6 to 36 carbon atoms. A monocyclic aryl group is more preferred. Specific examples of the aryl group include a phenyl, 4-tert-butylphenyl, 2-methylphenyl, 2,4,6-trimethylphenyl, 2-methoxyphenyl, 4-methoxyphenyl, 2,6-dichlorophenyl, 2-chlorophenyl or 2,4-dichlorophenyl group.

Y represents a hydrogen atom or a group capable of being released upon color development as described above. The group represented by Y includes the group capable of being released under an alkaline condition as described, for example, in JP-A-61-228444 and the group capable of being released upon the reaction with a developing agent as described, for example, in JP-A-56-133734. Y is preferably a hydrogen atom.

The coupler represented by the formula (1) may be a dimer or more, in which $R^6$ contains a residue of the coupler represented by the formula (1), or may be a homopolymer or a copolymer, in which $R^6$ contains a polymer chain. Typical examples of the homopolymer or copolymer include homopolymers or copolymers formed from an addition-polymerizable ethylenically unsaturated compound having a residue of the coupler represented by the formula (1). Such homopolymers or copolymers may contain one or more cyan color forming repeating units containing a residue of the coupler represented by the formula (1). The copolymers may contain one or more non-color forming ethylenic monomers which do not couple with an oxidation product of an aromatic primary amine developing agent, such as acrylates, methacrylates or maleates.

Specific examples of the cyan coupler represented by the formula (1) used in the present invention are set forth below, but the present invention should not be construed as being limited thereto.

(1)

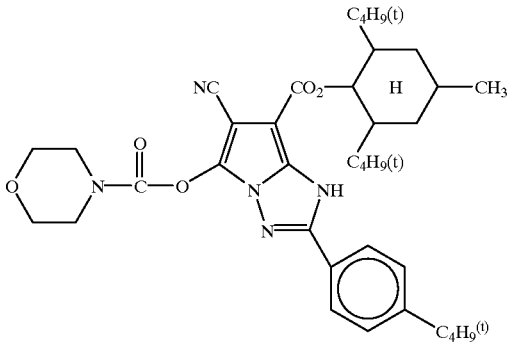

(2)

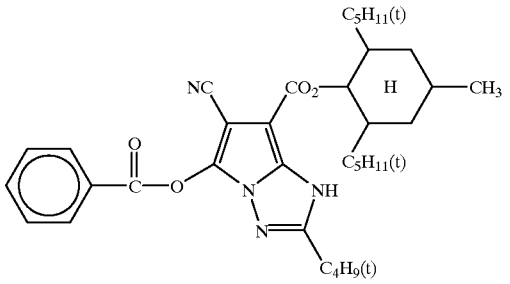

-continued
(3)
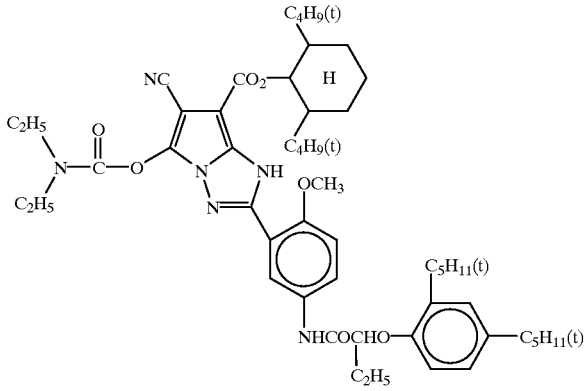
(4)
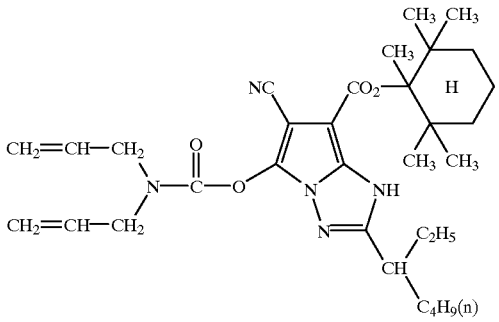
(5)
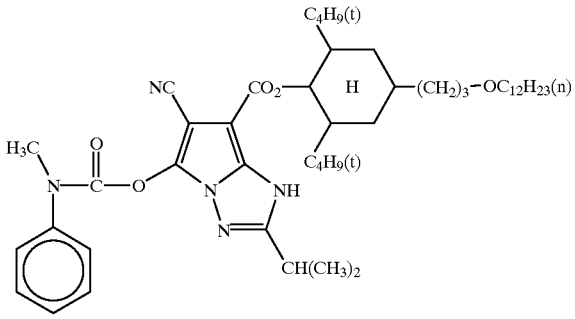
(6)
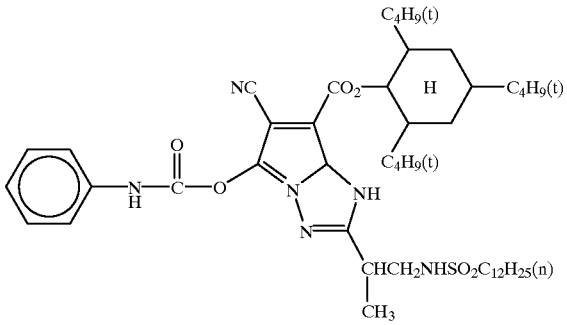
(7)
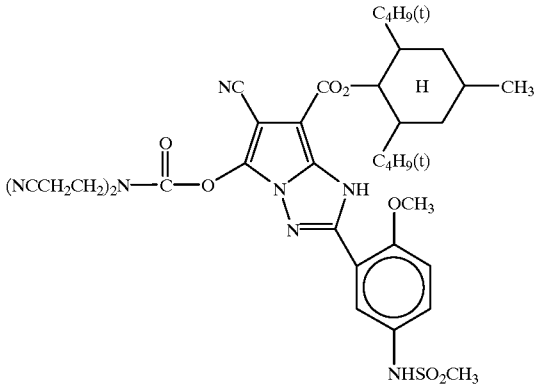
(8)
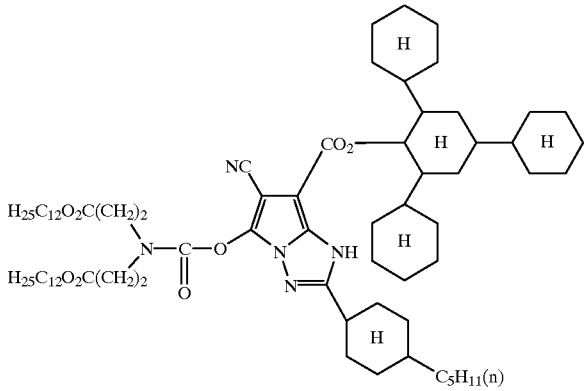
(9)
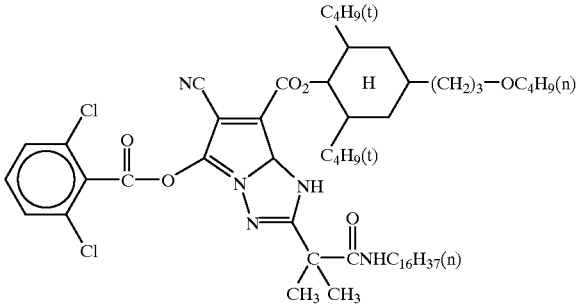
(10)
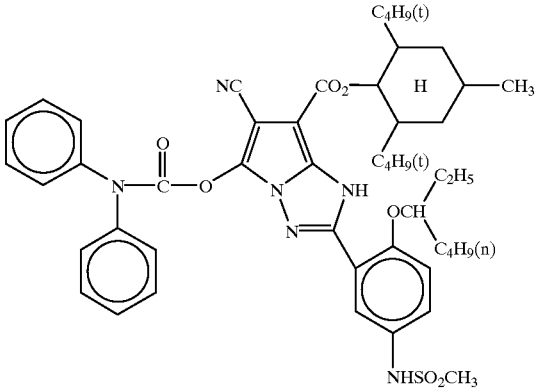

-continued
(11)
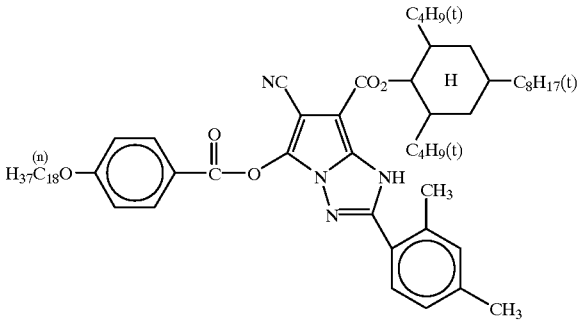
(12)
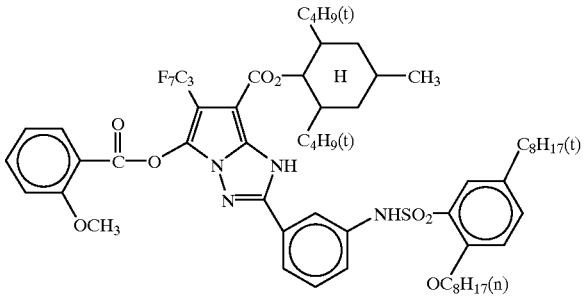
(13)
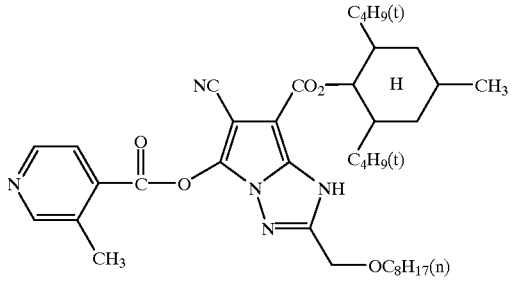
(14)
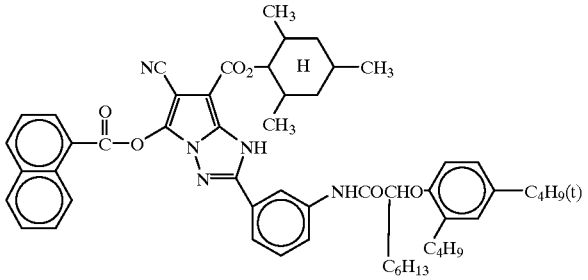
(15)
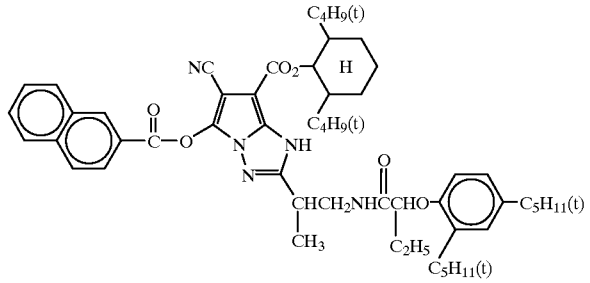
(16)
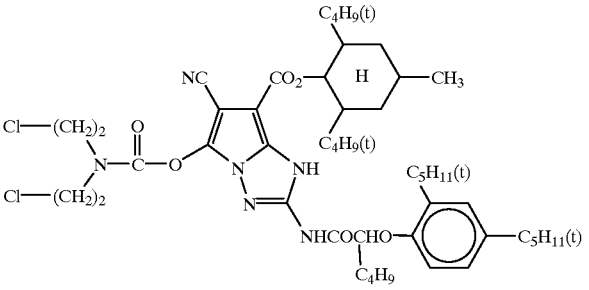
(17)
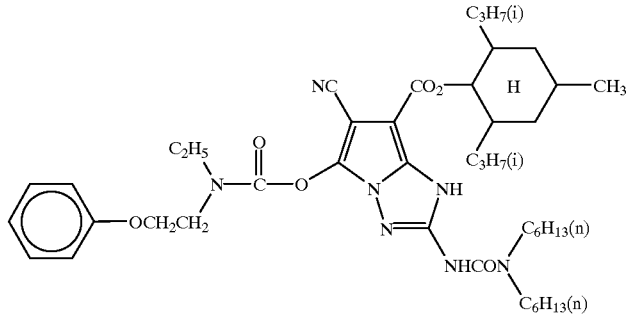

-continued
(18)
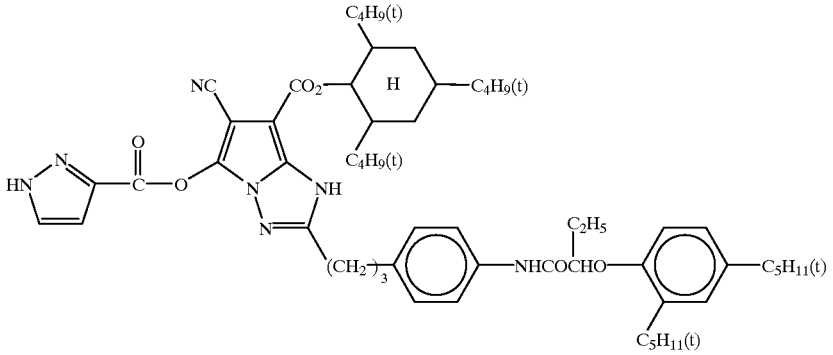
(19)
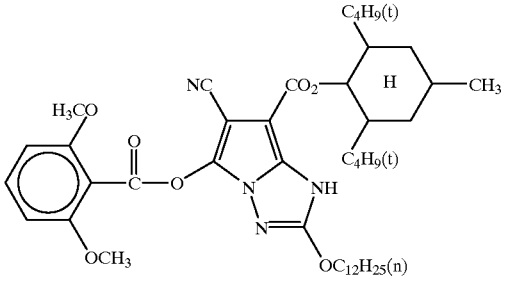
(20)
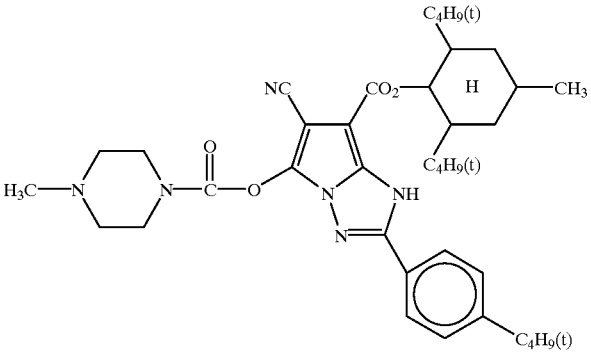
(21)
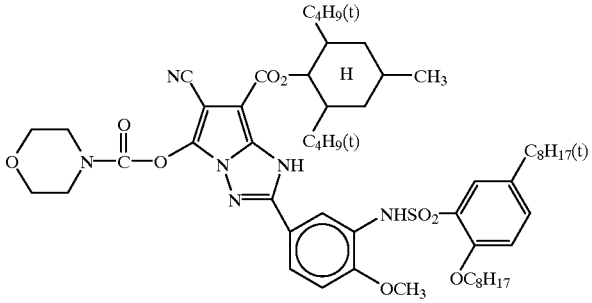
(22)
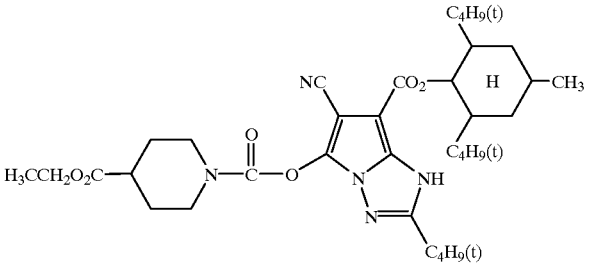
(23)
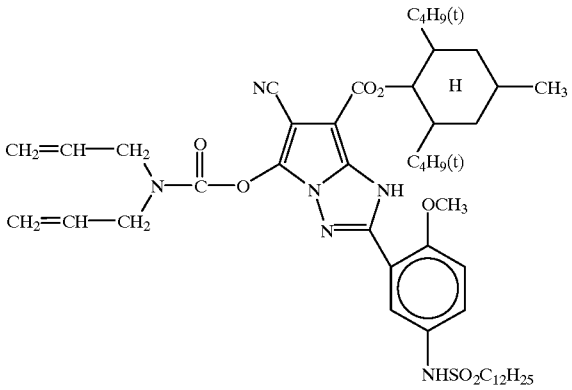
(24)
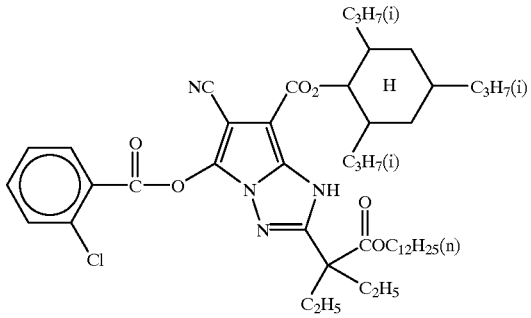

-continued
(25)
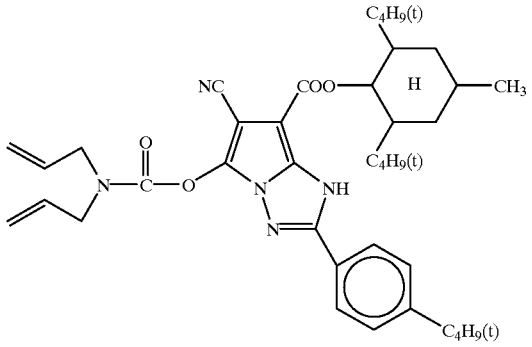
(26)
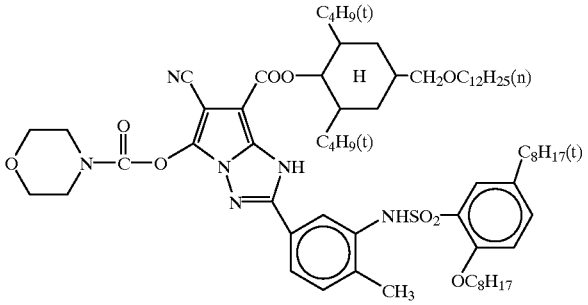
(27)
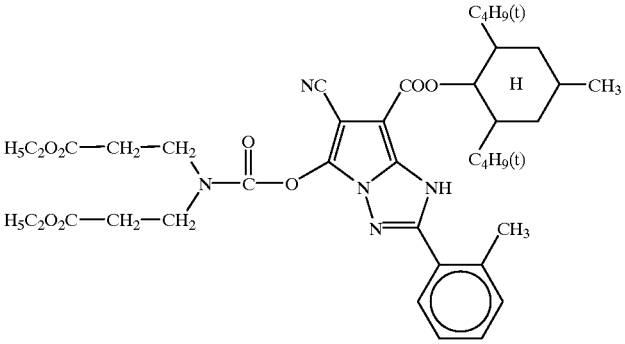
(28)
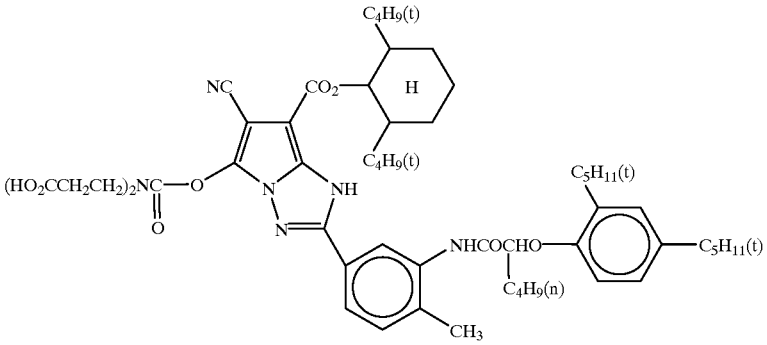
(29)
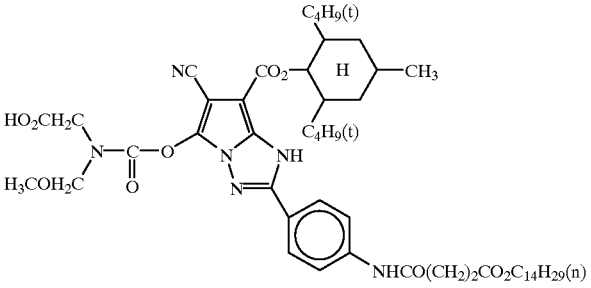
(30)
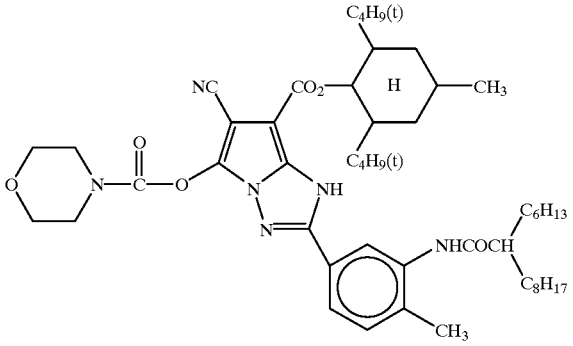

The compound represented by the formula (1) used in the present invention can be synthesized according to conventionally known methods, for example, methods described in JP-A-5-255333, JP-A-5-202004, JP-A-7-48376 and JP-A-8-110623.

Synthesis examples of the compound according to the present invention are specifically set forth below.

SYNTHESIS EXAMPLE 1

Synthesis of Compound (1)

Compound (1) was synthesized along the route shown below.

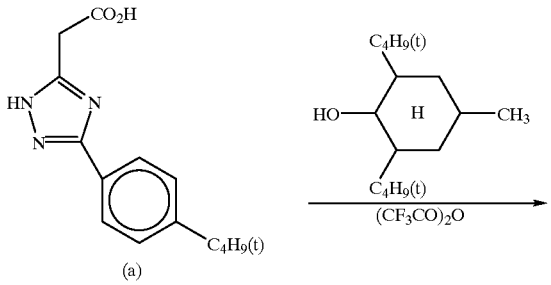

(a)

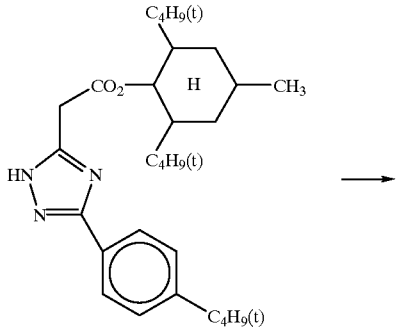

(b)

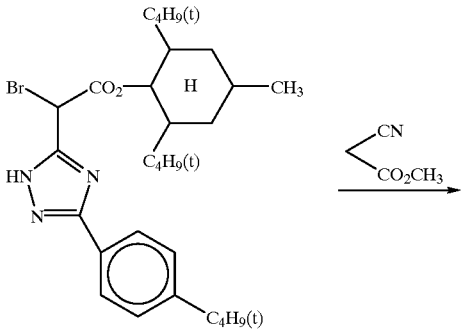

(c)

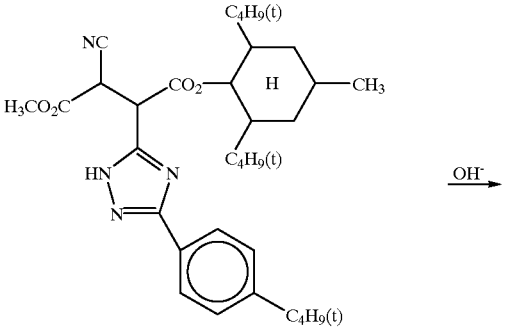

(d)

-continued

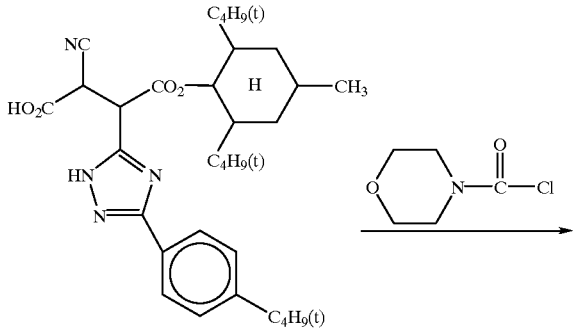

(e)

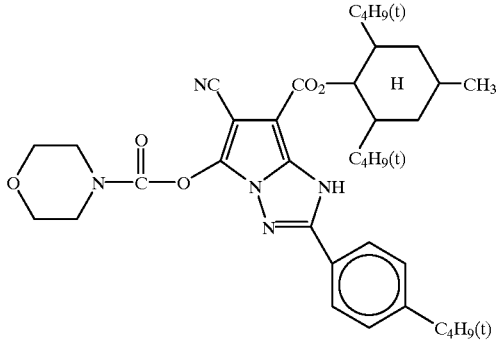

Synthesis of Compound (b)

To 200 ml of an acetonitrile solution containing 17 g (75 mmol) of 2,6-di-tert-butyl-4-methylcyclohexanol was dropwise added 10.6 ml (75 mmol) of trifluoroacetic anhydride at temperature of 0° C., and then 15.6 g (60.4 mmol) of Compound (a) was gradually added thereto. The reaction solution was stirred at room temperature for 2 hours and extracted by adding 300 ml of water and 300 ml of ethyl acetate. The organic layer was washed with an aqueous sodium bicarbonate solution, water and an aqueous sodium chloride solution in order and dried with magnesium sulfate. The solvent was distilled off under a reduced pressure and the residue was recrystallized from acetonitrile to obtain 19.6 g of Compound (b).

Synthesis of Compound (c)

To 200 ml of ethyl acetate solution containing 19.6 g Compound (b) was added 5 ml of pyridine, and bromine was dropwise added thereto under cooling with ice. The mixture was stirred for one hour and extracted by adding 300 ml of water and 300 ml of ethyl acetate. The ethyl acetate layer was dried with magnesium sulfate. The solvent was distilled off, and the residue was recrystallized by adding acetonitrile to obtain 18.0 g of Compound (c).

Synthesis of Compound (e)

To 20 ml of dimethylacetamide solution containing 2.2 g of methyl cyanoacetate was gradually added 0.8 g of sodium hydride at temperature of 0° C., and the mixture was stirred at room temperature for 30 minutes to prepare Solution S. 50 ml of dimethylacetamide solution containing 10.0 g of Compound (c) dissolved therein was gradually dropwise added to Solution S under cooling with ice. After stirring for one hour, to the reaction solution were added 20 ml of an aqueous solution containing 4 g of sodium hydroxide and 20 ml of methanol, and the mixture was stirred for one hour while maintaining the reaction temperature at 50° C. Then, 200 ml of ethyl acetate was added thereto, and the mixture was neutralized with aqueous hydrochloric acid and washed with water. The ethyl acetate layer was dried with magnesium sulfate and the solvent was distilled off under a reduced pressure to obtain Compound (e) in the crude form.

Synthesis of Compound (1)

To a solution containing 8.0 g of Compound (e) in the crude form dissolved in 40 ml of dimethylacetamide and 6 ml of pyridine was added 4.3 g of morpholinocarbamoyl chloride at temperature of 0° C. The mixture was stirred for 2 hours at room temperature to conduct reaction and poured into 200 ml of diluted aqueous hydrochloric acid and extracted with 200 ml of ethyl acetate. The organic layer was washed with water and dried with magnesium sulfate. The solvent was distilled off under a reduced pressure and the residue was crystallized by adding hexane to obtain 6.0 g of Compound (1). A melting point of Compound (1) was 256 to 257° C.

SYNTHESIS EXAMPLE 2

Synthesis of Compound (25)

In the step of Synthesis of Compound (1) described above, 4.5 g of diallylcarbamoyl chloride was used in place of 4.3 g of morpholinocarbamoyl chloride. The mixture was stirred for 2 hours at room temperature to conduct reaction and poured into 200 ml of diluted aqueous hydrochloric acid and extracted with 200 ml of ethyl acetate. The organic layer was washed with water and dried with magnesium sulfate. The solvent was distilled off under a reduced pressure and the residue was crystallized by adding hexane to obtain 5.5 g of Compound (25). A melting point of Compound (25) was 219 to 220° C.

Other compounds are synthesized in an analogous manner.

Now, the non-color forming colorless cyclic imide compound having a diffusion-resistant group which can be used in the present invention will be described in more detail below.

The diffusion-resistant group in a hydrophobic substituent which is provided to an organic substance for the purpose of fixing the organic substance in a desired layer. Owing to the presence of the diffusion-resistant group, the cyclic imide compound used in the present invention is decreased its water solubility to 2% or less, preferably 1% or less, and can stay in dispersed oil droplets of a high boiling point organic solvent. The diffusion-resistant group used ordinarily includes a substituted or unsubstituted alkyl group and a substituted or unsubstituted aryl group each having a certain size. In the cyclic imide compound according to the present invention, it is necessary to impart sufficient diffusion resistivity thereto since the imido group contained is a hydrophilic functional group. Therefore, although the diffusion-resistant group used in the cyclic imide compound according to the present invention may be varied depending on the presence of other hydrophilic group and the hydrophilicity thereof, it is preferably an alkyl group or an aryl group each having the total number of carbon atoms including substituent(s) of from 8 to 32. Taking a solubility of the compound to a high boiling point organic solvent into consideration, the diffusion-resistant group is more preferably an alkyl group or an aryl group each having the total number of carbon atoms including substituent(s) of from 12 to 22. A straight chain or branched chain alkyl group having from 12 to 20 carbon atoms is particularly preferred when the productivity is additionally considered. A number of the diffusion-resistant group present in the cyclic imide compound is preferably from 1 to 4, more preferably 1 or 2, and particularly preferably 1.

Specific examples of the diffusion-resistant group include an alkyl group (for example, n-octyl, n-decyl, n-dodecyl, n-tetradecyl, n-hexadecyl, n-octadecyl, n-octadecenyl, cyclohexyl, cyclopentyl, 2-ethylhexyl, 2-n-hexyl-n-decyl, 2-n-nonyl-n-dodecyl, isomyristyl, isopalmityl, or isostearyl), an acyl group, an acylamino group, an alkoxy group, an alkoxycarbonyl group, a carbamoyl group, an alkoxycarbonylamino group, a carbamoylamino group, a sulfenyl group, a sulfinyl group, a sulfonyl group, a sulfamoyl group, a sulfonylamino group and a sulfamoylamino group each having the alkyl moiety as above, an aryl group (for example, 2,5-di-tert-amylphenyl, 2,5-di-tert-butylphenyl, 4-tert-octylphenyl, or 3-n-pentadecylphenyl), an acyl group, an acylamino group, an aryloxy group, an aryloxycarbonyl group, a carbamoyl group, an aryloxycarbonylamino group, a carbamoylamino group, a sulfenyl group, a sulfinyl group, a sulfonyl group, a sulfamoyl group, a sulfonylamino group and a sulfamoylamino group each having the aryl moiety as above.

The term "non-color forming" used herein with respect to the cyclic imide compound means that the compound does not cause a coupling reaction with an oxidation product of a color developing agent upon color development for forming a dye. The term "colorless" used herein with respect to the cyclic imide compound means that the compound is substantially colorless before and after the incorporation thereof into a photographic light-sensitive material. Therefore, the non-color forming colorless cyclic imide compound having a diffusion-resistant group according to the present invention does not include a dye forming coupler, a coloring matter and a dye.

Of the non-color forming colorless cyclic imide compounds having a diffusion-resistant group used in the present invention, those represented by the formula (D) shown below are preferred.

(D)

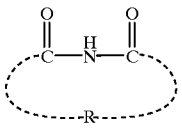

wherein R represents a non-metallic atomic group necessary to form a 5-membered or 6-membered ring together with the —CO—NH—CO— and the 5-membered or 6-membered ring has a diffusion-resistant group having from 8 to 22 carbon atoms as a substituent or a partial structure in a substituent.

In the formula (D), atoms constituting R include preferably a carbon atom, a nitrogen atom and an oxygen atom, and more preferably a carbon atom and a nitrogen atom. The ring formed from R together with the —CO—NH—CO— is preferably a 5-membered ring.

Among the cyclic imide compounds represented by the formula (D), those represented by the formula (A) or (B) shown below are more preferred:

(A)

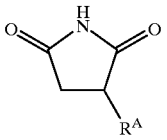

wherein $R^A$ represents a substituted or unsubstituted alkenyl group, a substituted or unsubstituted alkoxy group or a substituted or unsubstituted aryloxy group and $R^A$ is or contains a diffusion-resistant group having from 8 to 22 carbon atoms;

(B)

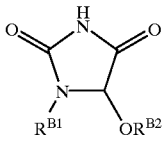

wherein $R^{B1}$ and $R^{B2}$, which may be the same or different, each represents a substituted or unsubstituted alkyl group or a substituted or unsubstituted aryl group and at least one of $R^{B1}$ and $R^{B2}$ is or contains a diffusion-resistant group having from 8 to 22 carbon atoms.

Now, the cyclic imide compounds represented by the formulae (A) and (B) will be described in more detail below.

In the formula (A), $R^A$ is preferably a substituted or unsubstituted alkenyl group having from 8 to 22 carbon atoms, a substituted or unsubstituted alkoxy having from 8 to 22 carbon atoms or a substituted aryloxy group having from 6 to 22 carbon atoms, more preferably an unsubstituted alkenyl group having from 12 to 20 carbon atoms, an unsubstituted alkoxy group having from 12 to 20 carbon atoms or a substituted aryloxy group having from 8 to 20 carbon atoms, and particularly preferably an unsubstituted alkenyl group having from 14 to 20 carbon atoms. When $R^A$ represents the alkenyl group, the unsaturated bond can be positioned in any part of $R^A$, and a mixture of isomers having different positions of the unsaturated bond may be employed. Also a mixture of the compounds wherein the partial alkyl portions in the alkenyl groups comprise different branched chains may be used. When $R^A$ represents the aryloxy group, the aryloxy group has a diffusion-resistant group having from 8 to 22 carbon atoms as or in its substituent.

In the formula (B), $R^{B1}$ is preferably an unsubstituted alkyl group having from 1 to 20 carbon atoms, a phenyl group or a benzyl group, more preferably a benzyl group, and particularly preferably an unsubstituted benzyl group. Further, $R^{B2}$ is preferably an unsubstituted alkyl group having from 1 to 20 carbon atoms, more preferably an unsubstituted straight-chain alkyl group having from 10 to 18 carbon atoms, and particularly preferably an unsubstituted straight-chain alkyl group having from 14 to 18 carbon atoms.

While $R^A$ in the formula (A), $R^{B1}$ and $R^{B2}$ in the formula (B) and R in the formula (D) may have a substituent as described above, examples of the substituent include those described for $R^6$ in the formula (1).

Specific examples of the non-color forming colorless cyclic imide compounds having a diffusion-resistant group which can be used in the present invention are set forth below, but the present invention should not be construed as being limited thereto.

Cyclic Imide Compounds Represented by the Formula (A)

(A-1)

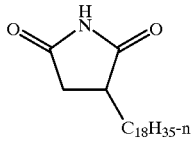

(mixture of isomers)

(A-2)

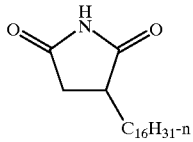

(mixture of isomers)

(A-3)

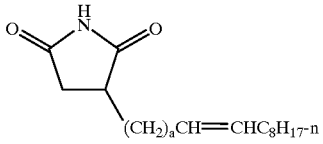

(A-4)

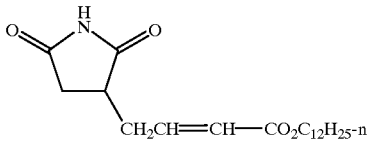

(A-5)

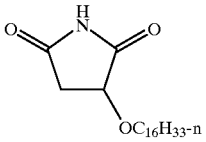

(A-6)

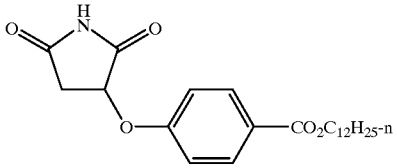

Cyclic Imide Compounds Represented by the Formula (B)

(B-1)

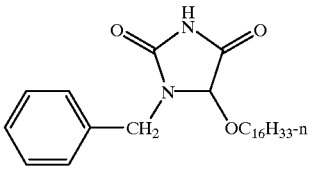

(B-2)

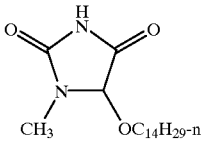

-continued
(B-3)
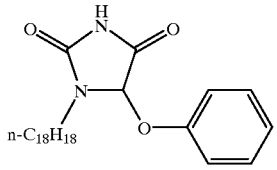
(B-4)
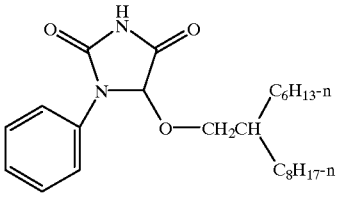
(B-5)
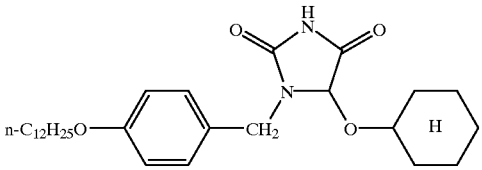
(B-6)
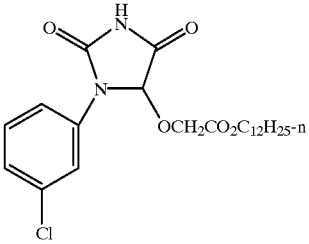
(B-7)
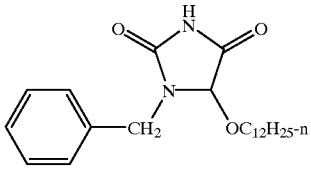
(B-8)
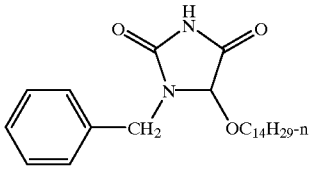
(B-9)
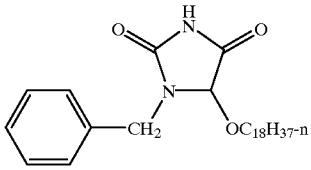
-continued
(B-10)
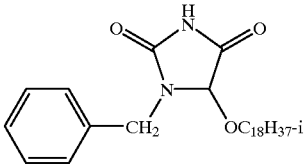
(B-11)
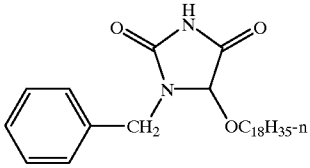
Cyclic Imide Compounds Represented by the Formula (D) (other than those represented by the formula (A) or (B))
(D-1)
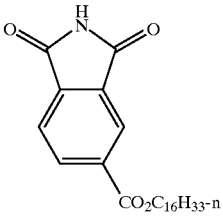
(D-2)
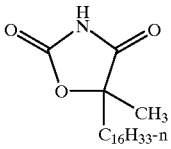
(D-3)
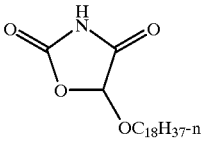
(D-4)
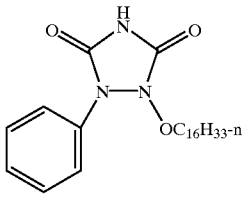
(D-5)
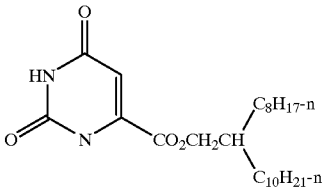

Synthesis examples of the cyclic imide compounds represented by the formula (A), (B) and (D) according to the present invention are specifically set forth below.

SYNTHESIS EXAMPLE 1

Synthesis of Compound (A-1)

(1) Synthesis of 5-hydroxy-1-benzylhydantoin

In a solvent mixture of 250 ml of acetic acid and 40 ml of ethyl acetate was dispersed 190 g of 1-benzylhydantoin and the mixture was refluxed under heating with stirring. To the mixture was added dropwise 164 g of bromine over a period of one hour, and the mixture was refluxed under heating for 30 minutes. The solvent was distilled off under a reduced pressure and the residue was allowed to stand for cooling. To the residue were added dropwise an aqueous sodium bicarbonate solution prepared by dissolving 53 g of sodium bicarbonate in 400 ml of water and then 200 ml of water. The reaction vessel was cooled with water and the crystals thus-deposited were collected by filtration, washed with water and dried to obtain 182 g of 5-hydroxy-1-benzylhydantoin as colorless crystals.

(2) Synthesis of Compound (A-1)

In 400 ml of toluene were dispersed 206 g of 5-hydroxy-1-benzylhydantoin, 242 g of acetylalcohol and 10 g of p-toluenesulfonic acid, and the mixture was refluxed under heating while removing water. The solvent was distilled off and the reaction vessel was cooled. To the residue was added 300 ml of acetonitrile to prepare a uniform solution. The solution was added dropwise to 2.5 l of cold water and the crystals thus-deposited were collected by filtration, washed with water and dried to obtain 414 g of Compound (A-1) as colorless crystals. A melting point of Compound (A-1) was 166 to 168° C.

SYNTHESIS EXAMPLE 2

Synthesis of Compound (B-1)

(1) Synthesis of n-octadecenylsuccinic monoamide 389 g of a 25% aqueous ammonia was mixed with 200 ml of acetonitrile and to the mixture was added 100 g of n-octadecenylsuccinic anhydride, followed by stirring for 2 hours at room temperature. The mixture was neutralized with concentrated hydrochloric acid. The crystals thus-deposited were collected by filtration, washed with water and then with acetonitrile, and dried to obtain 84.5 g of n-octadecenyl-succinic monoamide as colorless crystals.

(2) Synthesis of Compound (B-1)

In 200 ml of acetic anhydride was dispersed 50.0 g of n-octadecenylsuccinic monoamide and the mixture was refluxed for 2 hours. The acetic anhydride was distilled off 5and to the residue was added 150 ml of acetonitrile to prepare a uniform solution. The solution was cooled with ice water while stirring. The crystals thus-deposited were collected by filtration, washed with acetonitrile and dried to obtain 29.0 g of Compound (B-1) as colorless crystals. A melting point of Compound (B-1) was 89.0 to 91.0° C.

According to the present invention, when a non-color forming colorless carboxylic acid having a diffusion-resistant group or a salt thereof is employed in addition to the coupler represented by the formula (1) and the cyclic imide compound, preferably that represented by the formula (D), and more preferably that represented by the formula (A) or (B), as described above, the objects of the present invention are more effectively achieved. The result thus-obtained is unexpectedly better than the result obtained by the combination of the coupler represented by the formula (1) and the cyclic imide compound or the result obtained by the combination of the coupler represented by the formula (1) and the non-color forming colorless carboxylic acid having a diffusion-resistant group or a salt thereof. Particularly, the excellent result is obtained when the coupler represented by the formula (1), the cyclic imide compound represented by the formula (A) or (B) and a carboxylic acid or a salt thereof represented by the formula (C) shown below are employed in combination.

(C)

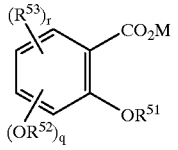

wherein $R^{51}$ and $R^{52}$ each represents a substituted or unsubstituted alkyl group, a substituted or unsubstituted aryl group, a substituted or unsubstituted acyl group, a substituted or unsubstituted carbamoyl group or a substituted or unsubstituted alkoxycarbonyl group; $R^{53}$ represents a halogen atom, a substituted or unsubstituted alkyl group, a substituted or unsubstituted aryl group, a substituted or unsubstituted acyl group, a substituted or unsubstituted carbamoyl group, a substituted or unsubstituted alkoxycarbonyl group, a substituted or unsubstituted sulfonyl group or a substituted or unsubstituted sulfamoyl group; at least one of $R^{51}$, $R^{52}$ and $R^{53}$ is or contains as a substituent a diffusion-resistant group having from 8 to 22 carbon atoms; M represents a hydrogen atom, a metal atom or an ammonium; q represents an integer of from 0 to 2; r represents an integer of from 0 to 4; and provided that the sum of q and r is 4 or less.

The non-color forming colorless carboxylic acid having a diffusion-resistant group and a salt thereof are collectively referred to the non-color forming colorless carboxylic acid compound having a diffusion-resistant group sometimes hereinafter.

The non-color forming colorless carboxylic acid having a diffusion-resistant group preferably used include those described in Japanese Patent Application No. 9-23021.

Now, the carboxylic acid compound represented by the formula (C) will be described in more detail below.

The halogen atom represented by $R^{53}$ in the formula (C) is preferably a fluorine atom, a chlorine atom or a bromine atom, more preferably a fluorine atom or a chlorine atom, and particularly preferably a chlorine atom.

The substituted or unsubstituted alkyl group represented by $R^{51}$, $R^{52}$ and $R^{53}$ in the formula (C) is preferably a straight chain, branched chain or cyclic alkyl group having from 1 to 30 carbon atoms, more preferably a straight chain or branched chain alkyl group having from 1 to 22 carbon atoms, and particularly preferably a straight chain alkyl group having from 1 to 20 carbon atoms.

The substituted or unsubstituted aryl group represented by $R^{51}$, $R^{52}$ and $R^{53}$ in the formula (C) is preferably an aryl group having from 6 to 20 carbon atoms, more preferably an aryl group having from 6 to 14 carbon atoms, and particularly preferably an aryl group having from 6 to 10 carbon atoms.

The substituted or unsubstituted acyl group represented by $R^{51}$, $R^{52}$ and $R^{53}$ in the formula (C) is preferably an acyl group represented by the formula of —$COR^{61}$, wherein $R^{61}$ represents a hydrogen atom, a substituted or unsubstituted alkyl group or a substituted or unsubstituted aryl group.

The substituted or unsubstituted carbamoyl group represented by $R^{51}$, $R^{52}$ and $R^{53}$ in the formula (C) is preferably a carbamoyl group represented by the formula of —$CONR^{62}R^{63}$, wherein $R^{62}$ and $R^{63}$ each represents a hydrogen atom, a substituted or unsubstituted alkyl group or a substituted or unsubstituted aryl group.

The substituted or unsubstituted alkoxycarbonyl group represented by $R^{51}$, $R^{52}$ and $R^{53}$ in the formula (C) is preferably an alkoxycarbonyl group represented by the formula of —$CO_2R^{64}$, wherein $R^{64}$ represents a hydrogen atom, a substituted or unsubstituted alkyl group or a substituted or unsubstituted aryl group.

The substituted or unsubstituted sulfonyl group represented by $R^{53}$ in the formula (C) is preferably a sulfonyl group represented by the formula of —$SO_2R^{65}$, wherein $R^{65}$ represents a hydrogen atom, a substituted or unsubstituted alkyl group or a substituted or unsubstituted aryl group.

The substituted or unsubstituted sulfamoyl group represented by $R^{53}$ in the formula (C) is preferably a sulfonyl group represented by the formula of —$SO_2NR^{66}R^{67}$, wherein $R^{66}$ and $R^{67}$ each represents a hydrogen atom, a substituted or unsubstituted alkyl group or a substituted or unsubstituted aryl group.

The substituted or unsubstituted alkyl group represented by $R^{61}$, $R^{62}$, $R^{63}$, $R^{64}$, $R^{65}$, $R^{66}$ or R in the above formulae is preferably a straight chain, branched chain or cyclic alkyl group having from 1 to 30 carbon atoms, more preferably a straight chain or branched chain alkyl group having from 1 to 22 carbon toms, and particularly preferably a straight chain alkyl group having from 1 to 20 carbon atoms.

The substituted or unsubstituted aryl group represented by $R^{61}$, $R^{62}$, $R^{63}$, $R^{64}$, $R^{65}$, $R^{66}$ or $R^{67}$ in the above formulae is preferably an aryl group having from 6 to 20 carbon atoms, more preferably an aryl group having from 6 to 14 carbon atoms, and particularly preferably an aryl group having from 6 to 10 carbon atoms.

The metal atom represented by M in the formula (C) is preferably an alkali metal atom, more preferably a lithium atom, a potassium atom or a sodium atom, and particularly preferably a sodium atom.

The ammonium represented by M in the formula (C) is preferably an ammonium represented by the formula of $NR^{81}R^{82}R^{83}R^{84}$ wherein $R^{81}$, $R^{82}$ $R^{83}$ and $R^{84}$ each represents a hydrogen atom, a substituted or unsubstituted alkyl group or a substituted or unsubstituted aryl group.

The substituted or unsubstituted alkyl group represented by $R^{81}$, $R^{82}$, $R^{83}$ and $R^{84}$ in the above formula is preferably a straight chain, branched chain or cyclic alkyl group having from 1 to 20 carbon atoms, more preferably a straight chain or branched chain alkyl group having from 1 to 8 carbon atoms, and particularly preferably a straight chain alkyl group having from 1 to 4 carbon atoms.

The substituted or unsubstituted aryl group represented by $R^{81}$, $R^{82}$, $R^{83}$ and $R^{84}$ in the above formula is preferably an aryl group having from 6 to 20 carbon atoms, more preferably an aryl group having from 6 to 14 carbon atoms, and particularly preferably an aryl group having from 6 to 10 carbon atoms.

$R^{81}$, $R^{82}$, $R^{83}$ and $R^{84}$ in the above formula each is preferably a hydrogen atom or an alkyl group, more preferably a hydrogen atom or a lower alkyl group having from 1 to 4 carbon atoms, and particularly preferably a hydrogen atom.

In the formula (C), M is preferably a hydrogen atom or a sodium atom, and particularly preferably a hydrogen atom.

In the formula (C), $R^{51}$ and $R^{52}$ each is preferably a substituted or unsubstituted alkyl group or a substituted or unsubstituted aryl group, and more preferably a substituted or unsubstituted alkyl group.

In the formula (C), $R^{53}$ is preferably a halogen atom, a substituted or unsubstituted alkyl group, a substituted or unsubstituted acyl group, a substituted or unsubstituted carbamoyl group or a substituted or unsubstituted alkoxycarbonyl group, and more preferably a halogen atom or an unsubstituted alkyl group.

In the formula (C), q is preferably an integer of 0 or 1, more preferably 0; and r is preferably an integer of from 0 to 3, more preferably an integer of from 0 to 2, and particularly preferably an integer of 0 or 1.

In the formula (C), when q is an integer of two or more, plural (O—$R^{52}$)s may be the same or different; and when r is an integer of two or more, plural $R^{53}$s may be the same or different.

In the formula (C), the groups represented by $R^{51}$, $R^{52}$ and $R^{53}$ may be substituted, respectively, as described above, and examples of the substituent include those described for $R^6$ in the formula (1).

Specific examples of the non-color forming colorless carboxylic acid compounds having a diffusion-resistant group which can be used in the present invention are set forth below, but the present invention should not be construed as being limited thereto.

Carboxylic Acid Compounds Represented by the Formula (C)

(C-1)

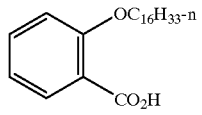

(C-2)

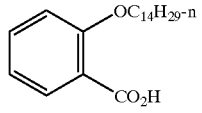

(C-3)

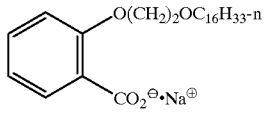

(C-4)

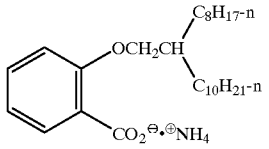

(C-5)

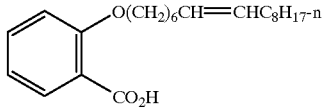

(C-6)

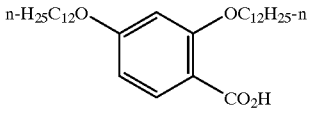

-continued (C-7)

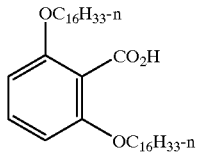

(C-8)

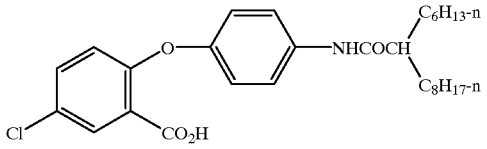

(C-9)

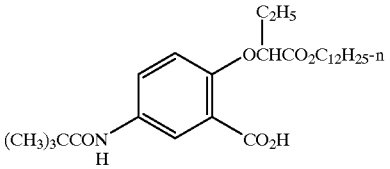

(C-10)

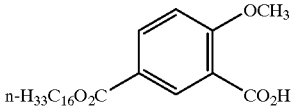

(C-11)

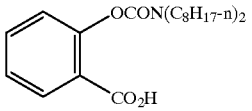

(C-12)

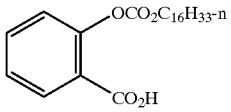

Carboxylic Acid Compounds other than those Represented by the Formula (C)

(AC-1)

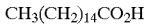

(AC-2)

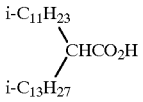

(AC-3)

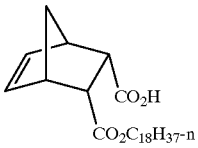

(AC-4)

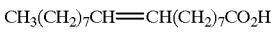

(AC-5)

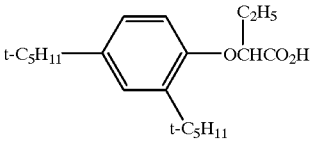

-continued (AC-6)

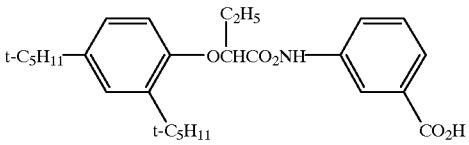

(AC-7)

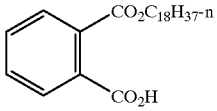

Synthesis examples of the carboxylic acid compounds having a diffusion-resistant group which can be used in the present invention are specifically set forth below.

SYNTHESIS EXAMPLE 1

Synthesis of Compound (AC-3)

A mixture of 50.0 g of 5-norbornene-2,3-dicarboxylic acid anhydride and 82.5 g of n-octadecyl alcohol was heated at 80° C. for 6 hours with stirring. The mixture was dissolved in 0.2 liters of hot ethyl acetate and to the solution was added 0.15 liters of acetonitrile, followed by allowing to stand for cooling. The crystals thus-deposited were collected by filtration, washed with acetonitrile and dried to obtain Compound (AC-3) as colorless crystals. A melting point of Compound (AC-3) was 60.0 to 64.0° C.

SYNTHESIS EXAMPLE 2

Synthesis of Compound (C-1)

In one liter of N,N-dimethylformamide, were dispersed 378 g of methyl salicylate, 760 g of 1-bromohexadecane and 413 g of anhydrous potassium carbonate and the dispersion was stirred at 95° C. for 2 hours. The reaction mixture was poured into water and extracted with ethyl acetate. The organic layer was washed with water, separated and the solvent was distilled off under a reduced pressure. The residue was dispersed in one liter of methanol and to the dispersion was added an aqueous sodium hydroxide solution prepared by dissolving 120 g of sodium hydroxide in 0.24 liters of water, followed by refluxing with heating for 1.5 hours. After cooling, 0.26 liters of concentrated hydrochloric acid was added to the reaction mixture, and the mixture was poured into water and extracted with ethyl acetate. The organic layer was washed with water and dried with magnesium sulfate. The magnesium sulfate was removed by filtration and the solvent was distilled off under a reduced pressure. The crude product thus-obtained was recrystallized from a solvent mixture of acetonitrile and ethyl acetate (10:1) to obtain 722 g of Compound (C-1) as colorless crystals. A melting point of Compound (C-1) was 60.0–61.5° C.

Other compounds are synthesized in an analogous manner with reference to the synthesis examples described above.

The silver halide color photographic light-sensitive material of the present invention is characterized by containing the coupler according to the present invention and the non-color forming colorless cyclic imide compound having a diffusion-resistant group according to the present invention. A layer to which the coupler according to the present invention is added is not particularly limited as far as the layer is a hydrophilic colloid layer provided on a support of the color photographic light-sensitive material. In general, a color photographic light-sensitive material comprises a support having provided thereon at least one blue-sensitive silver halide emulsion layer, at least one green-sensitive silver halide emulsion layer and at least one red-sensitive sliver halide emulsion layer in this order. However, the order of the layers can be varied. Further, an infrared-sensitive silver halide emulsion layer may be employed in place of one of the above-described light-sensitive silver halide emulsion layers. Color reproduction can be effected according to the subtractive color process by incorporating into these light-sensitive layers color couplers capable of forming dyes having a complementary color relationship to light to which the corresponding silver halide emulsion is sensitive, respectively. Further, a constitution of a different correspondence of the light-sensitive emulsion to hue of the dye formed from the color coupler from that described above may be employed.

The coupler according to the present invention if particularly preferably employed in a red-sensitive silver halide emulsion layer of a color photographic light-sensitive material. The amount of the coupler according to the preset invention incorporated into a hydrophilic colloid layer of the color photographic light-sensitive material is ordinarily from $1\times10^{-3}$ to 1 mol, preferably from $2\times10^{-3}$ to $3\times10^{-1}$ mol, per mol of silver halide in the layer.

The non-color forming colorless cyclic imide compound having a diffusion-resistant group according to the present invention is incorporated into at least one layer provided on a support of the color photographic light-sensitive material. The layer is not particularly limited as far as it is a hydrophilic colloid layer. It is preferred to incorporate the compound into a silver halide emulsion layer containing the coupler represented by the formula (1).

The non-color forming colorless cyclic imide compound or carboxylic acid compound having a diffusion-resistant group according to the present invention mainly functions as a high boiling point organic solvent. The term "high boiling point" used herein means a boiling point of not less than 175° C. at a normal pressure. The amount of the non-color forming colorless cyclic imide compound or carboxylic acid compound having a diffusion-resistant group according to the present invention used is not particularly limited and may be varied depending on the purpose. The amount of the compound to be used is preferably from 0.0002 g to 20 g, more preferably from 0.001 g to 5 g, per $m^2$ of the photographic light-sensitive material, and it is preferably in a range of from 0.1 to 8 parts by weight, more preferably in a range of from 0.1 to 4 parts by weight, per 1 part by weight of the coupler represented by the formula (1).

The amount of material to be dispersed containing the non-color forming colorless cyclic imide compound or carboxylic acid compound having a diffusion-resistant group according to the present invention and a photographically useful agent including a coupler to a dispersion medium is preferably in a range of from 2 to 0.1 parts by weight, more preferably in a range of from 1.0 to 0.2 parts by weight, per 1 part by weight of the dispersion medium. The dispersion medium includes a hydrophilic polymer, for example, polyvinyl alcohol and gelatin which is typical. The dispersion may contain various compounds depending on the purpose in addition to the coupler and non-color forming colorless cyclic imide compound or carboxylic acid compound having a diffusion-resistant group according to the present invention and photographically useful agent(s).

The non-color forming colorless cyclic imide compound or carboxylic acid compound having a diffusion-resistant group according to the present invention can be employed together with a conventionally known high boiling point organic solvent. When the known high boiling point organic solvent is used together, the amount of the non-color forming colorless cyclic imide compound or carboxylic acid compound having a diffusion-resistant group according to the present invention is preferably from 10 to 200% by weight, more preferably 20 to 150% by weight, based on the total amount of the known high boiling point organic solvent. The known high boiling point organic solvent which is preferably used together with the cyclic imide compound according to the present invention has suitably a dielectric constant of from 2.0 to 7.0, and preferably a dielectric constant of from 3.0 to 6.0.

Examples of the high boiling point solvent used together with the non-color forming colorless cyclic imide compound or carboxylic acid compound having a diffusion-resistant group according to the present invention are described in U.S. Pat. No. 2,322,027.

Specific examples of the high boiling point organic solvent having a boiling point of not less than 175° C. at a normal pressure include phthalic acid esters (for example dibutyl phthalate, dicyclohexyl phthalate, di-2-ethylhexyl phthalate, didecyl phthalate, bis(2,4-di-tert-amylphenyl) phthalate, bis(2,4-di-tert-amylphenyl) isophthalate, or bis(1,1-diethylpropyl) phthalate, phosphoric acid or phosphonic acid esters (for example, triphenyl phosphate, tricresyl phosphate, 2-ethylhexyl diphenyl phosphate, tricyclohexyl phosphate, tri-2-ethylhexyl phosphate, tridodecyl phosphate, tributoxyethyl phosphate, tri-chloropropyl phosphate, or di-2-ethylhexyl phenyl phosphonate), benzoic acid esters (for example, 2-ethylhexyl benzoate, dodecyl benzoate, or 2-ethylhexyl-p-hydroxy-benzoate), amides (for example, N,N-diethyldodecanamide, N,N-diethyllaurylamide, or N-tetradecylpyrrolidone), sulfonamides (for example, N-butylbenzenesulfonamide), alcohols or phenols (for example, isostearyl alcohol, or 2,4-di-tert-amylphenol), aliphatic carboxylic acid esters (for example, bis(2-ethylhexyl) sebacate, dioctyl azelate, glycerol tributyrate, isostearyl lactate, or trioctyl citrate), aniline derivatives (for example, N,N-dibutyl-2-butoxy-5-tert-octylaniline), hydrocarbons (for example, paraffin, dodecylbenzene, or diisopropylnaphthalene) and chlorinated paraffins.

Phosphoric acid esters and amides are particularly preferably employed as the high boiling point organic solvent used together with the coupler represented by the formula (1) according to the present invention. At least one compound selected from the phosphoric acid esters and amides is preferably employed alone or together with other high boiling point organic solvent. More preferably, at least one of the phosphoric acid ester is used together with at least one of the amides, or at least one of the phosphoric acid esters and at least one of the amide are used together with other high boiling point organic solvent.

The phosphoric acid esters and amides which are preferably employed in the present invention include those represented by the following formulae (SP) and (SA), respectively.

(SP)

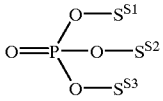

(SA)

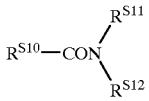

In the formula (SP), $R^{S1}$, $R^{S2}$ and $R^{S3}$, which may be the same or different, each represents an alkyl group or a phenyl group. These groups may be substituted, and examples of the substituent include preferably those described for $R^6$ in the formula (1). The total number of carbon atoms included in $R^{S1}$, $R^{S2}$ and $R^{S3}$ is preferably from 15 to 54. More preferably, all of $R^{S1}$, $R^{S2}$ and $R^{S3}$ are phenyl groups. The substituent for the phenyl group is preferably an alkyl group, more preferably a branched chain alkyl group, and particularly preferably an isopropyl group.

In the formula (SA), $R^{S10}$ and $R^{S11}$, which may be the same or different, each represents an alkyl group or a phenyl group; and $R^{S12}$ represents a hydrogen atom, an alkyl group or a phenyl group. These groups may be substituted, and examples of the substituent include preferably those described for $R^6$ in the formula (1). The total number of carbon atoms included in $R^{S10}$, $R^{S11}$ and $R^{S12}$ is preferably from 10 to 60. $R^{S12}$ is preferably an alkyl group or a phenyl group which may be substituted. More preferably, $R^{S10}$ is a phenyl group which may be substituted.

Of the compounds represented by the formula (SA), those represented by the formula (SA-I) shown in below are preferred.

(SA-I)

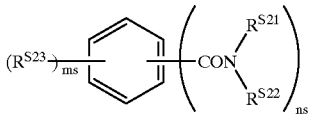

In the formula (SA-I), $R^{S21}$ and $R^{S22}$, which may be the same or different, each represents an alkyl group; $R^{S23}$ represents a substituent and ns represents an integer of from 1 to 6; and ms represents an integer of from 0 to 5. The alkyl group represented by $R^{S21}$ or $R^{S22}$ may be substituted, and examples of the substituent include preferably those described for $R^6$ in the formula (1). ns is preferably an integer of from 1 to 3, more preferably an integer of 2 or 3, and particularly preferably 2. ms is preferably an integer of from 0 to 3, more preferably an integer of 0 or 1, and particularly preferably 0. When ns is an integer of two or more, plural —$CONR^{S21}(R^{S22})$s may be the same or different. When ms is an integer of two or more, plural $R^{S23}$s may be the same or different. When ns is an integer of 2, it is preferred that the position of these groups on the benzene ring is a meta-position or a para-position each other.

Specific examples of the compounds represented by the formula (SP) or (SA) which can be used in the present invention are set forth below, but the present invention should not be construed as being limited thereto.

(SP-1)

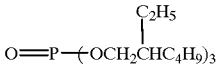

(SP-2)

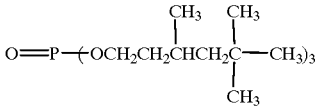

(SP-3)

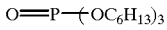

(SP-4)

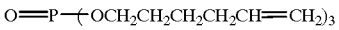

(SP-5)

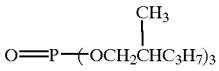

(SP-6)

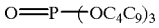

(SP-7)

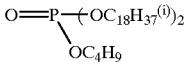

(SP-8)

(SP-9)

(SP-10)

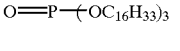

(SP-11)

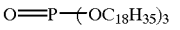

(SP-12)

(SP-13)

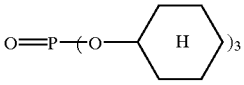

(SP-14)

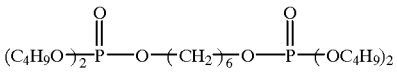

(SP-15)

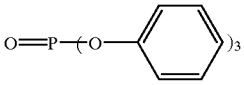

(SP-16)

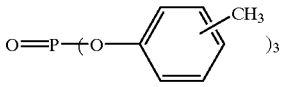

(SP-17)

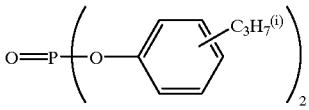

-continued
(SP-18)
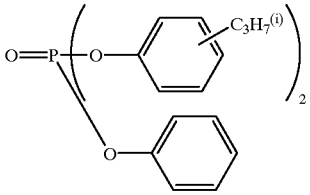
(SP-19)
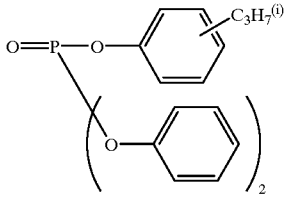
(SP-20)
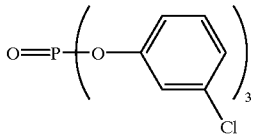
(SP-21)
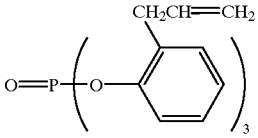
(SP-22)
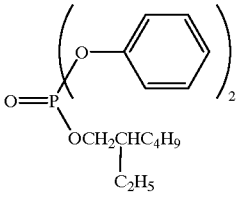
(SP-23)
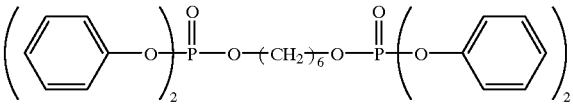
(SA-1)
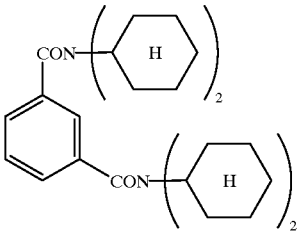
(SA-2)
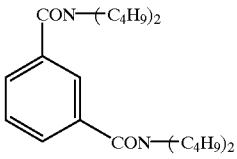
-continued
(SA-3)
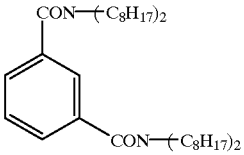
(SA-4)
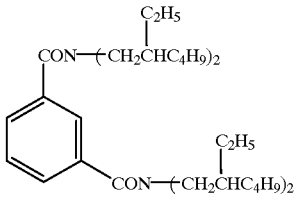
(SA-5)
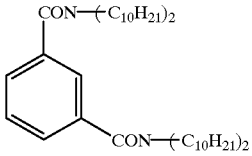
(SA-6)
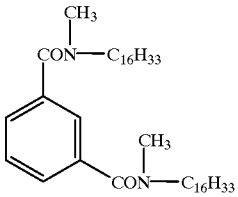
(SA-7)
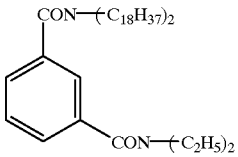
(SA-8)
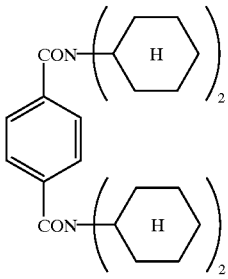
(SA-9)
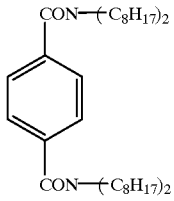

-continued
(SA-10)
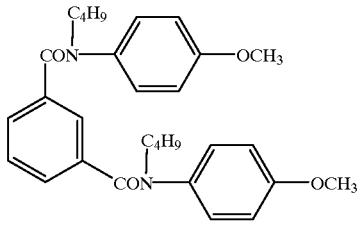
(SA-11)
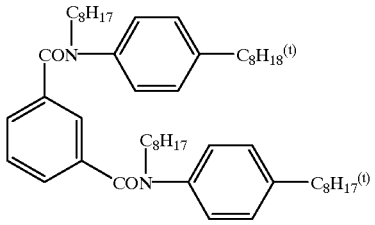
(SA-12)
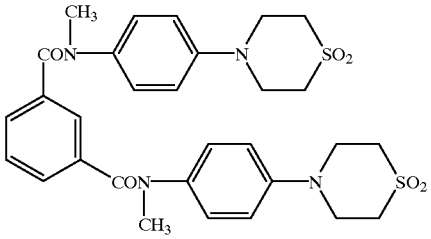
(SA-13)
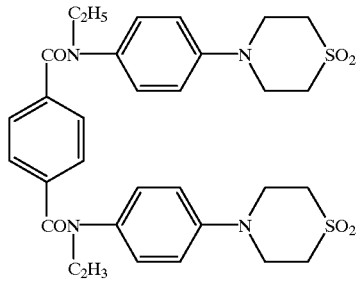
(SA-14)
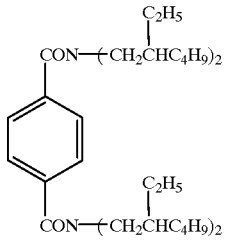
(SA-15)
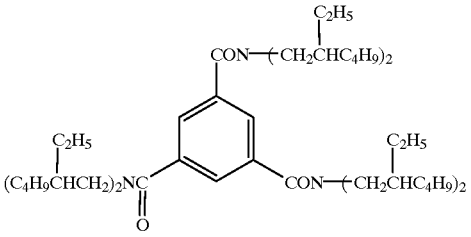
-continued
(SA-16)
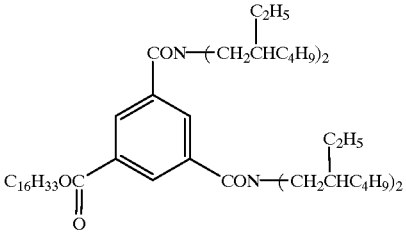
(SA-17)
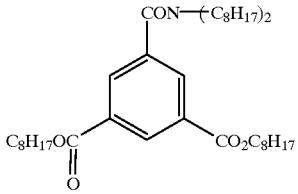
(SA-18)
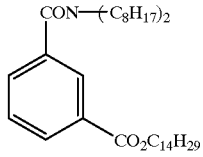
(SA-19)
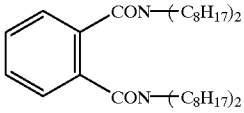
(SA-20)
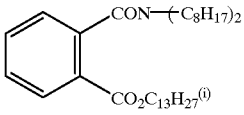
(SA-21)
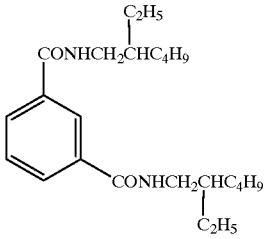
(SA-22)
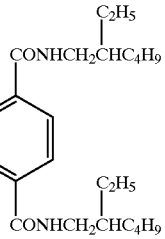

-continued (SA-23)

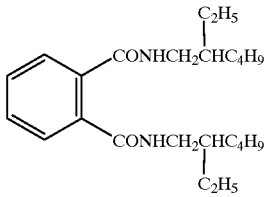

(SA-24)

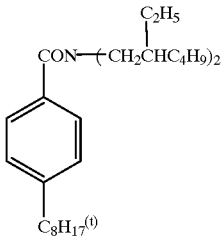

(SA-25)

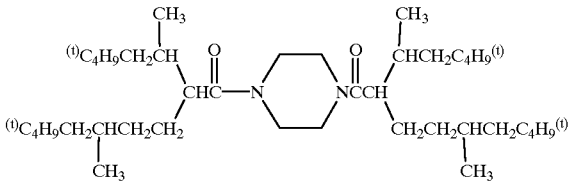

(SA-26)

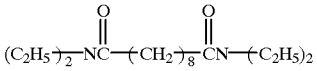

(SA-27)

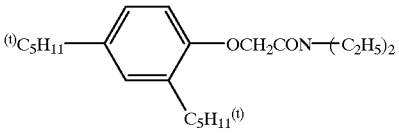

(SA-28)

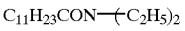

(SA-29)

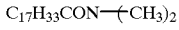

In the color photographic light-sensitive material according to the present invention, it is preferred to employ the compound represented by the formula (SA), since color reproducibility is remarkably improved.

It is also preferred to employ the compound represented by the formula (SP), since light fastness is improved as well as color reproducibility is improved.

To employ at least one of the compounds represented by the formula (SP) and at least one of the compounds represented by the formula (SA) in combination is particularly preferred, since the extremely large improvement in color reproducibility and light fastness can be achieved.

An organic solvent having a boiling point of not less than 30° C., preferably having a boiling point of from 50° C. to about 160° C. is used as an auxiliary solvent. Typical examples of the organic solvent include ethyl acetate, butyl acetate, ethyl propionate, methyl ethyl ketone, cyclohexanone, 2-ethoxyethyl acetate and dimethylformamide.

It is preferred that a color fading preventing agent, a competing compound, a cyan stain preventing agent which prevents cyan stain caused by an aromatic primary amine developing agent remained in the layer after the color development processing, or a phenolic cyan coupler (which is also useful as a dye stabilizer) is employed in addition to the non-color forming colorless cyclic imide compound or carboxylic acid compound having a diffusion-resistant group and the high boiling point organic solvent in the silver halide emulsion layer containing the cyan coupler represented by the formula (1) according to the present invention. Suitable examples of these compounds include, in addition to the compounds described in JP-A-62-215272, JP-A-2-33144 and European Laid Open Patent 335,660, the compounds described in JP-A-5-150426, U.S. Pat. Nos. 5,352,573 and 5,330,888, European Laid Open Patent 606,659 and Japanese Patent Application No. 8-126445 as the color fading preventing agent; phenidones, hydroquinones, catechols, gallic acid compounds, sulfonamidobenzenes, hydrazides, hydroxylamines and dissolving-out type couplers, specifically the compounds described in U.S. Pat. Nos. 5,330,888, 5,403,704 and 5,547,825 and JP-A-6-83002 as the competing compound; the compounds described in European Laid Open Patent 544,317 as the cyan stain preventing agent which prevents cyan stain caused by an aromatic primary amine developing agent remained in the layer after the color development processing; and the compounds described in U.S. Pat. No. 5,378,596 and Japanese Patent Application No. 8-101556 as the phenolic cyan coupler.

Among these compounds, those represented by the formulae (ADA), (ADB), (ADC), (ADD), (ADE) and (ADF) shown below are particularly preferred.

Color Fading Preventing Agent (ADA)

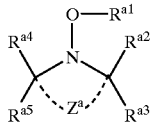

In the formula (ADA), $R^{a1}$ represents a radical (•), an alkyl group, an alkenyl group or an aryl group; $R^{a2}$, $R^{a3}$, $R^{a4}$ and $R^{a5}$, which may be the same or different, each represents a hydrogen atom or an alkyl group; and za represents a non-metallic atomic group necessary to form a 5-membered or 6-membered ring. Each of these groups and the non-metallic atomic group may be substituted, and examples of the substituent include preferably those described for $R^6$ in the formula (1). The total number of carbon atoms included in the compound represented by the formula (ADA) is preferably from 10 to 60.

Competing Compound (ADB)

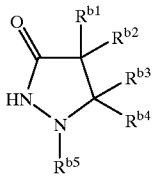

In the formula (ADB), $R^{b1}$, $R^{b2}$, $R^{b3}$ and $R^{b4}$, which may be the same or different, each represents a hydrogen atom, an alkyl group or an aryl group; and $R^{b5}$ represents an aryl group. Each of these groups may be substituted, and examples of the substituent include preferably those described for $R^6$ in the formula (1). The total number of carbon atoms included in $R^{b1}$, $R^{b2}$, $R^{b3}$, $R^{b4}$ and $R^{b5}$ is preferably from 15 to 60. Of the compounds represented by the formula (ADB), compounds wherein $R^{b1}$ represents a hydrogen atom and $R^{b2}$ represents an alkyl group or an aryl group and compounds wherein $R^{b1}$ and $R^{b2}$ each represents an alkyl group having not less than 2 carbon atoms or an aryl group are preferred.

In the formula (ADB), $R^{b1}$, $R^{b2}$, $R^{b3}$ and $R^{b4}$ each preferably represents a hydrogen atom or an alkyl group. $R^{b5}$ preferably represents a phenyl group which may be substituted, and preferred examples of the substituent on the phenyl group include an alkyl group, an alkoxy group, a sulfonamido group and an acylamino group. Of the compounds represented by the formula (ADB), compounds wherein $R^{b1}$ represents a hydrogen atom, $R^{b2}$ represents an alkyl group and $R^{b5}$ represents a phenyl group which may be substituted are particularly preferred.

Cyan Stain Preventing Agent (ADC)

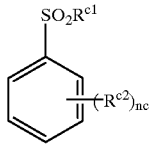

(ADD)

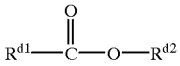

(ADE)

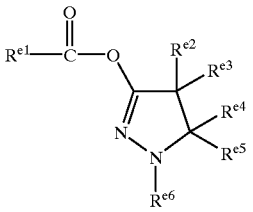

In the formula (ADC), $R^{c1}$ represents a hydrogen atom, a metal atom or an ammonium; $R^{c2}$ represents a substituent; and nc represents an integer of from 1 to 5. When nc is an integer of two or more, plural $R^{c2}$s may be the same or different. The substituent represented by $R^{c2}$ is preferably that described for $R^6$ in the formula (1). It is preferred that at least one of $R^{c2}$s has 8 to 30 carbon atoms. It is also preferred that $R^{c2}$ represents an alkyl group, an aryl group, a heterocyclic group, an alkoxy group, an aryloxy group, an alkylthio group, an arylthio group, an alkoxycarbonyl group, an aryloxycarbonyl group, a carbamoyl group, a sulfamoyl group, an amido group, a sulfonyl group, a halogen atom, a cyano group, an alkylamino group or an arylamino group. Particularly, in the compound represented by the formula (ADC), the sum of a Hammet's substituent constant σ value (σm, σp and σo, and σo is substituted by σp) of $R^{c2}$ to the $—SO_2R^{c1}$ group is preferably 0 or more, more preferably 0.2 or more.

In the formula (ADD), $R^{d1}$ represents an alkyl group, an aryl group, a heterocyclic group, an alkoxy group, an aryloxy group, an alkylamino group or an arylamino group; and $R^{d2}$ represents an aryl group. Each of these groups may be substituted, and examples of the substituent include preferably those described for $R^6$ in the formula (1). The total number of carbon atoms included in $R^{d1}$ and $R^{d2}$ is preferably from 15 to 60. $R^{d2}$ preferably represents a phenyl group which may be substituted, and preferred examples of the substituent on the phenyl group include an alkyl group, an aryl group, a heterocyclic group, an alkoxy group, an aryloxy group, an alkylthio group, an arylthio group, a halogen atom, an alkoxycarbonyl group, an aryloxycarbonyl group, a carbamoyl group, a sulfamoyl group, an amido group, a sulfonyl group and a cyano group. Further, a substituent in that the sum of a Hammet's substituent constant σ value (σm, σp and σo, and σo is substituted by σp) to the $R^{d1}C(O)O—$ group is 0 or more is preferred as the substituent on the phenyl group.

In the formula (ADE), $R^{e1}$ has the same meaning as defined for $R^{d1}$ in the formula (ADD); $R^{e2}$, $R^{e3}$, $R^{e4}$ and $R^{e5}$ have the same meanings as defined for $R^{b1}$, $R^{b2}$, $R^{b3}$ and $R^{b4}$ in the formula (ADB), respectively; and $R^{e6}$ has the same meaning as defined for $R^{b5}$ in the formula (ADB). The total number of carbon atoms included in $R^{e2}$, $R^{e3}$, $R^{e4}$, $R^{e5}$ and $R^{e6}$ and preferred groups therefor are the same as those described for $R^{b1}$, $R^{b2}$, $R^{b3}$, $R^{b4}$ and $R^{b5}$ in the formula (ADB), respectively.

Phenolic Cyan Coupler (ADF)

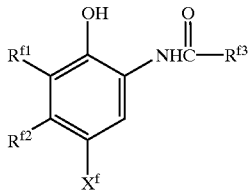

In the formula (ADF), $X^f$ represents a hydrogen atom or an atom or group capable of being released upon a coupling reaction with an oxidation product of an aromatic amine developing agent; $R^{f1}$ and $R^{f2}$, which may be the same or different, each represents a hydrogen atom or a substituent or $R^{f1}$ and $R^{f2}$ may be combined with each other to form a 5-membered or 6-membered ring; and $R^{f3}$ represents an alkyl group, a aryl group, an alkylamino group or an arylamino group. Each of these groups may be substituted, and examples of the substituent include preferably those described for $R^6$ in the formula (1). At least one of $R^{f1}$, $R^{f2}$ and $R^{f3}$ has 8 or more carbon atoms. $R^{f1}$ preferably represents a hydrogen atom, an alkyl group or a halogen atom, $R^{f2}$ preferably represents an alkyl group, an acylamino group or a ureido group; and $X^f$ preferably represents a halogen atom or a hydrogen atom.

Specific examples of the compounds represented by the formula (ADA), (ADB), (ADC), (ADD), (ADE) or (ADF) which can be used in the present invention are set forth below, but the present invention should not be construed as being limited thereto.

Compounds Represented by the Formula (ADA)
(ADA-1)
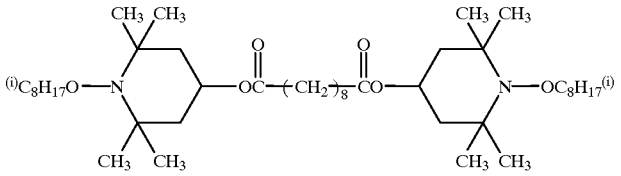
(ADA-2)
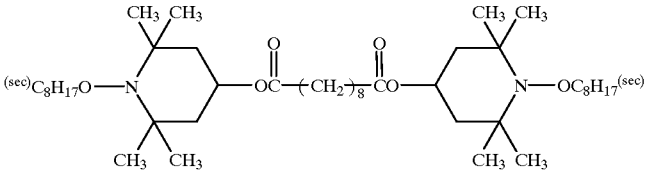
(ADA-3)
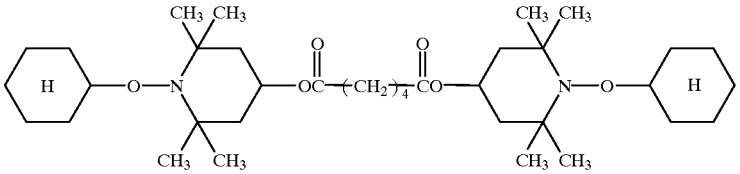
(ADA-4)
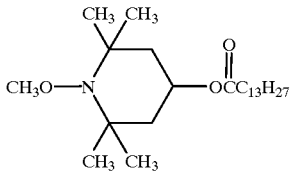
(ADA-5)
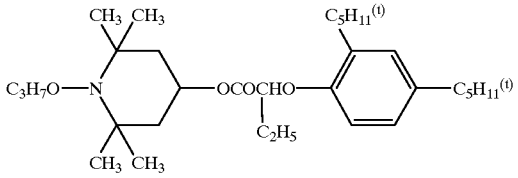
(ADA-6)
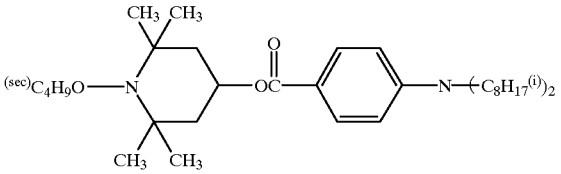
(ADA-7)
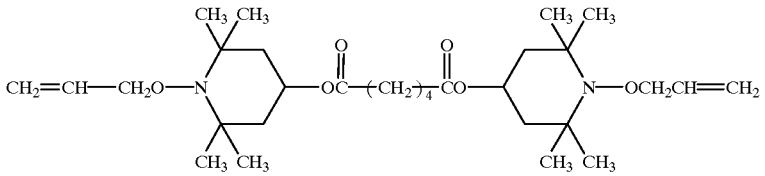
(ADA-8)
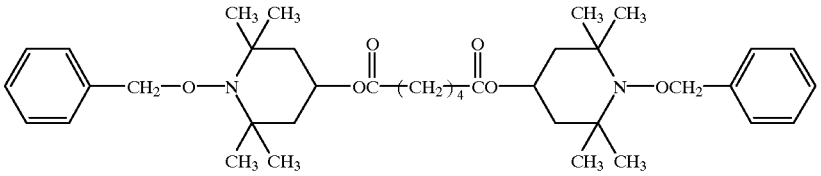

-continued
(ADA-9)
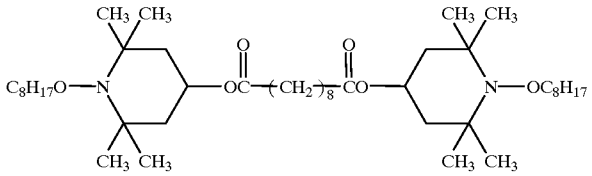
(ADA-10)
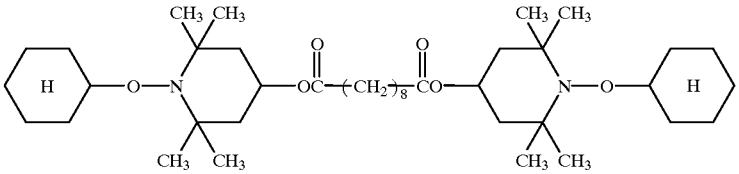
(ADA-11)
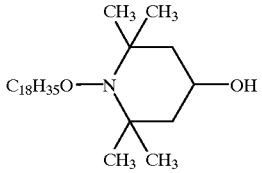
(ADA-12)
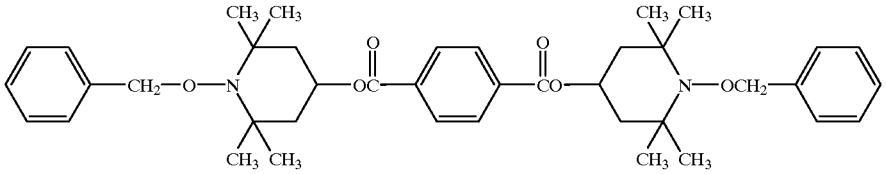
(ADA-13)
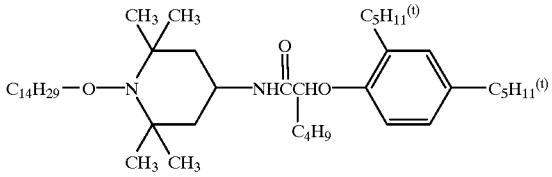
(ADA-14)
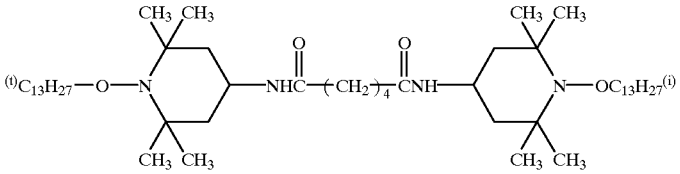
(ADA-15)
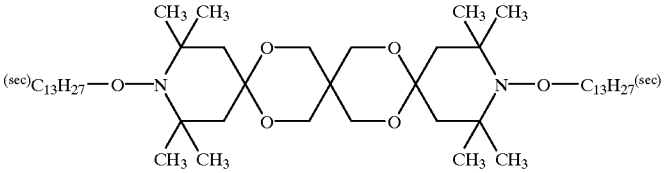
(ADA-16)
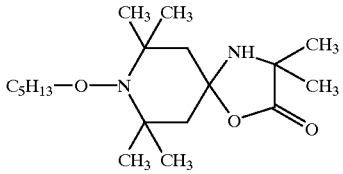

-continued
(ADA-17)
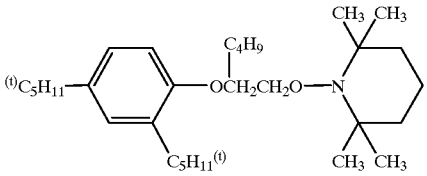
(ADA-18)
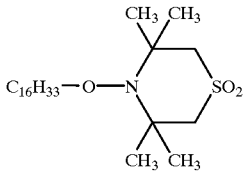
(ADA-19)
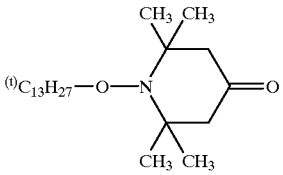
(ADA-20)
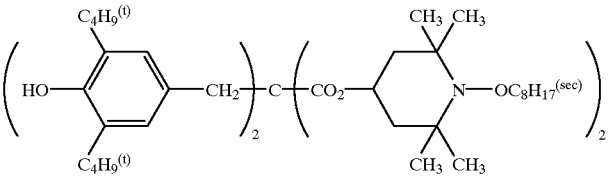
(ADA-21)
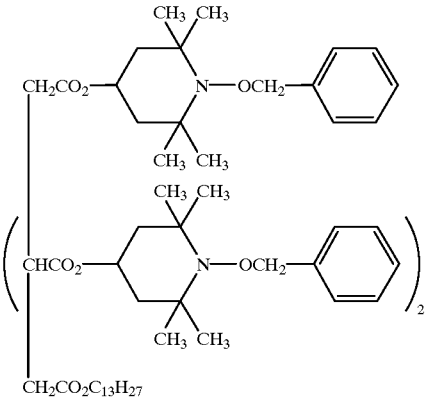
(ADA-22)
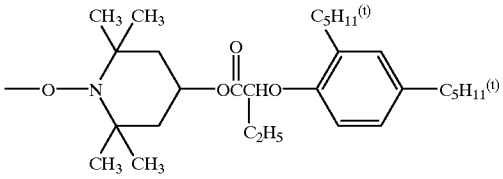
(ADA-23)
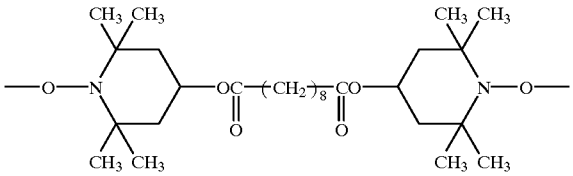

-continued
(ADA-24)
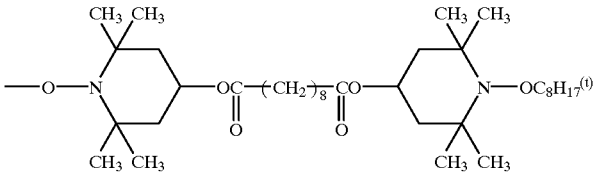
(ADA-25)
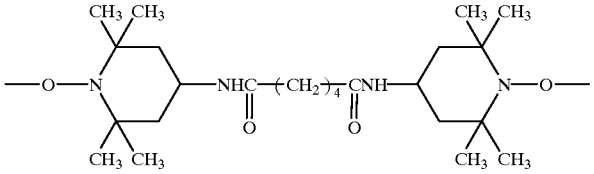
(ADA-26)
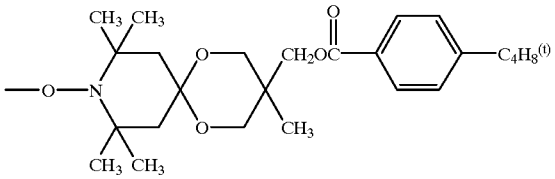
(ADA-27)
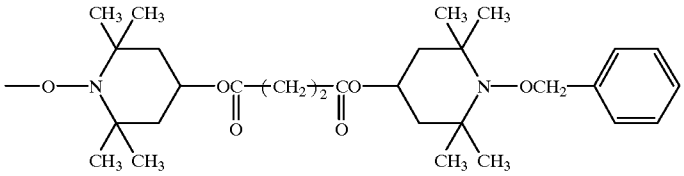
Compounds Represented by the Formula (ADB)
(ADB-1)
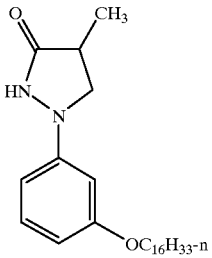
(ADB-2)
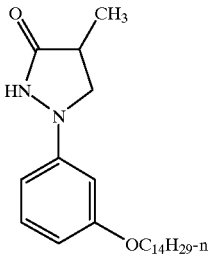
-continued
(ADB-3)
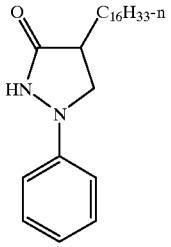
(ADB-4)
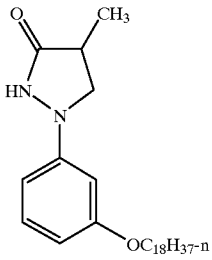

-continued
(ADB-5)
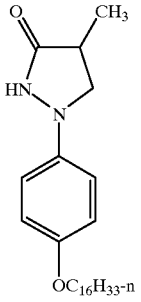
(ADB-6)
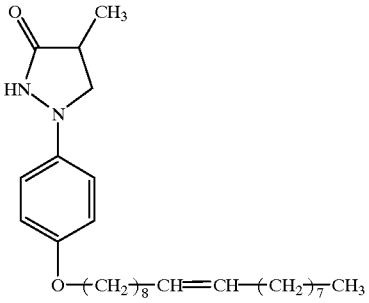
(ADB-7)
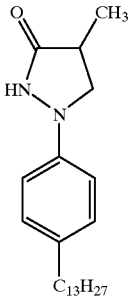
(ADB-8)
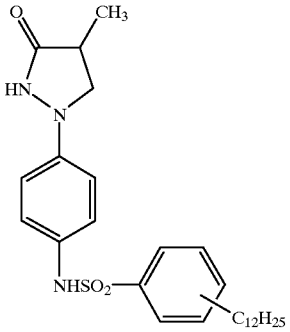
(ADB-9)
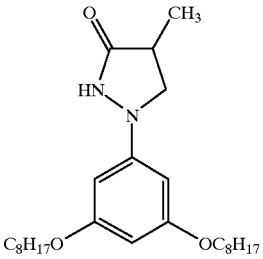
-continued
(ADB-10)
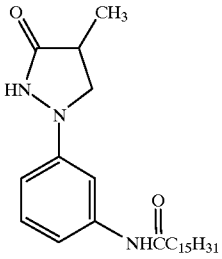
(ADB-11)
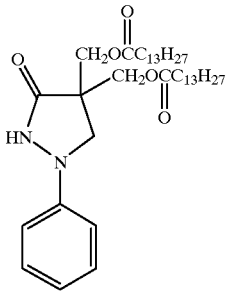
(ADB-12)
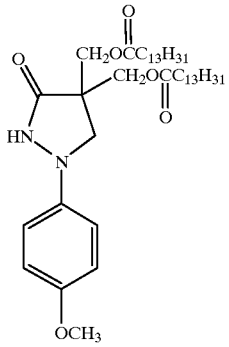
(ADB-13)
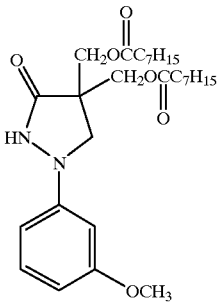

-continued
(ADB-14)
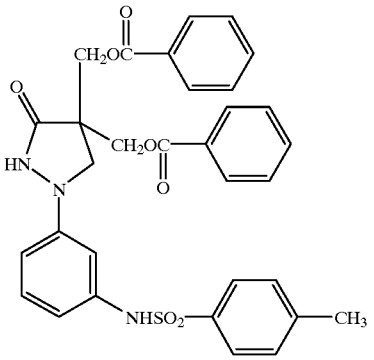
(ADB-15)
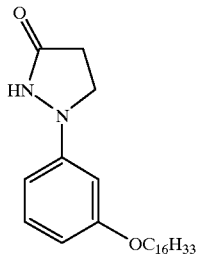
(ADB-16)
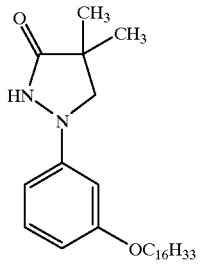
(ADB-17)
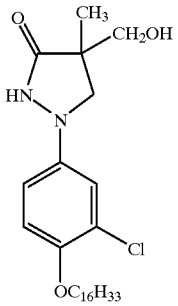
(ADB-18)
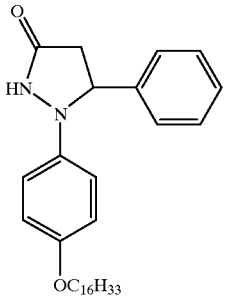
-continued
(ADB-19)
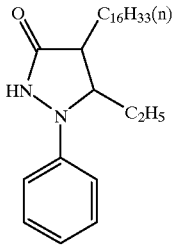
(ADB-20)
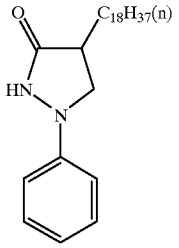
(ADB-21)
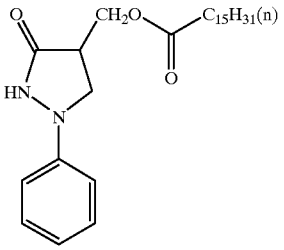
(ADB-22)
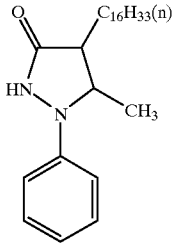
(ADB-23)
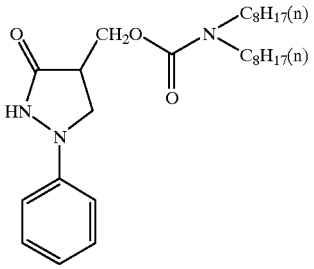

Compounds Represented by the Formula (ADC), (ADD) or (ADE)
(ADC-1)
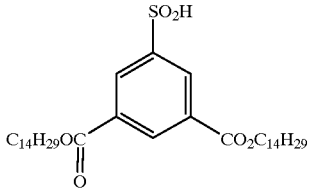
(ADC-2)
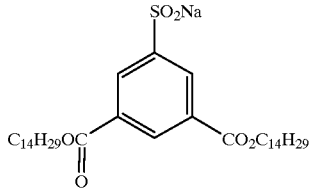
(ADC-3)
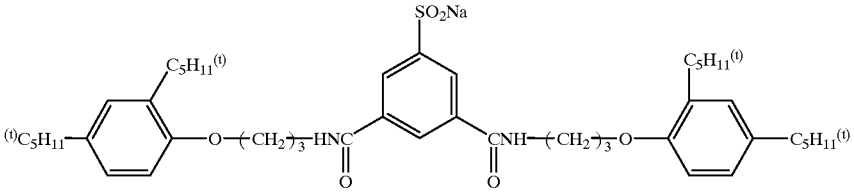
(ADC-4)
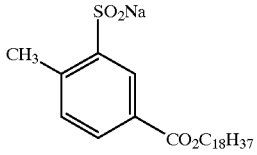
(ADC-5)
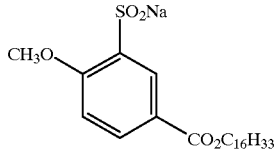
(ADC-6)
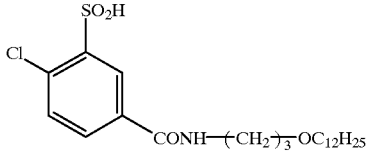
(ADC-7)
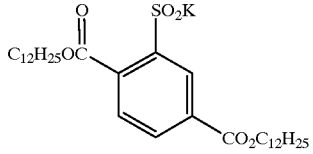
(ADC-8)
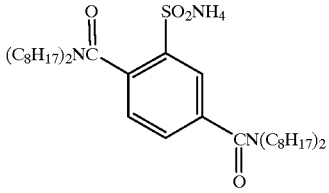
(ADD-1)
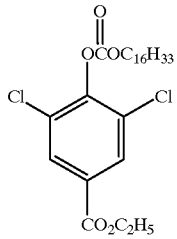
(ADD-2)
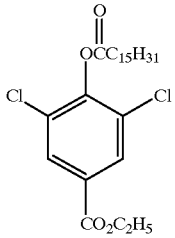
(ADD-3)
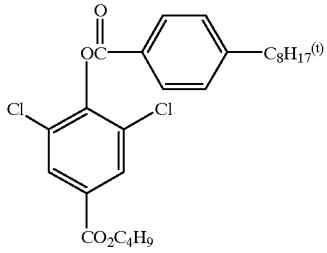

-continued
(ADD-4)
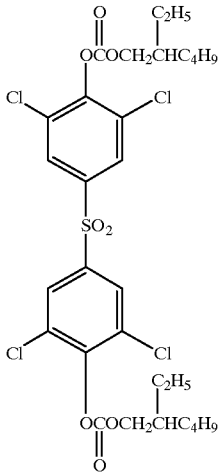
(ADD-5)
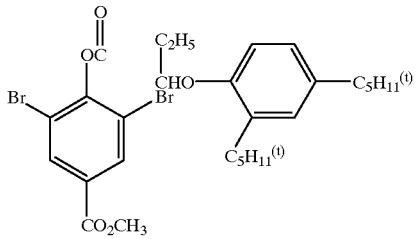
(ADD-6)
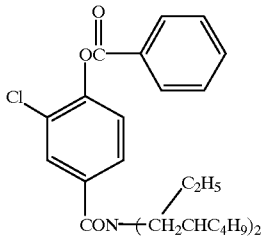
(ADD-6)
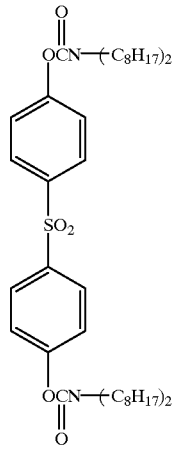
(ADE-1)
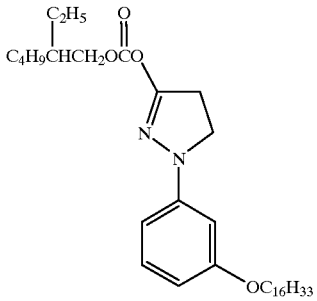
(ADE-2)
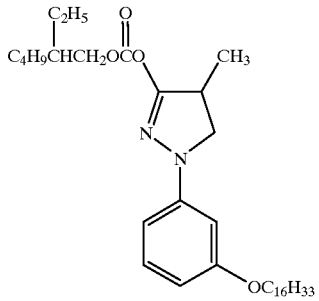
(ADE-3)
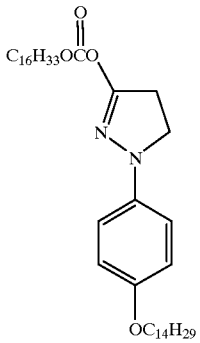
(ADE-4)
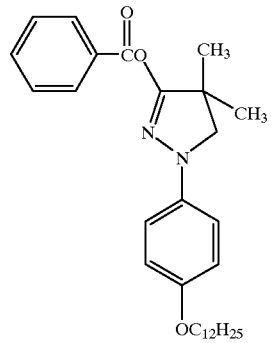

-continued
(ADE-5)
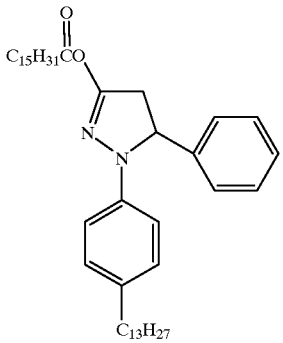
(ADE-6)
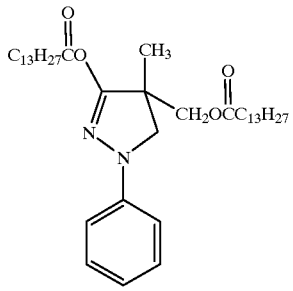
(ADE-7)
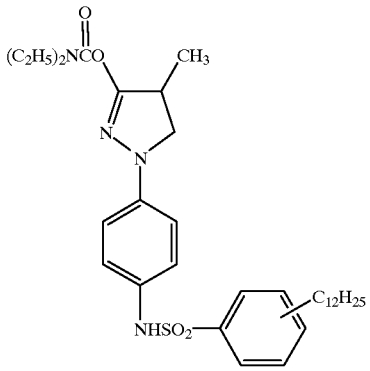
Compounds Represented by the Formula (ADF)
(ADF-1)
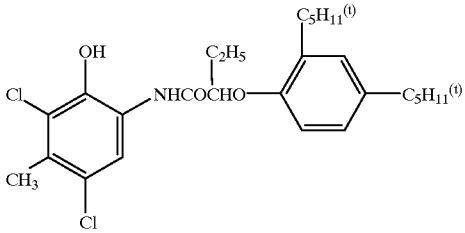
(ADF-2)
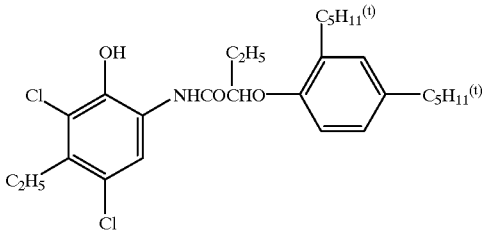
-continued
(ADF-3)
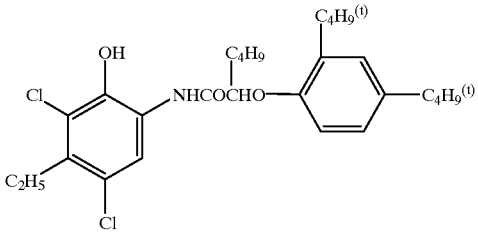
(ADF-4)
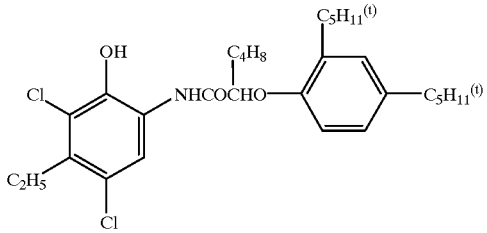
(ADF-5)
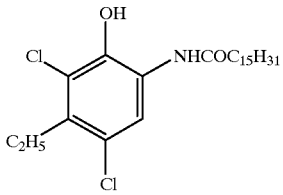

-continued (ADF-6)

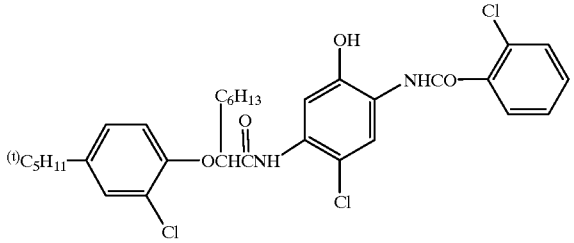

(ADF-7)

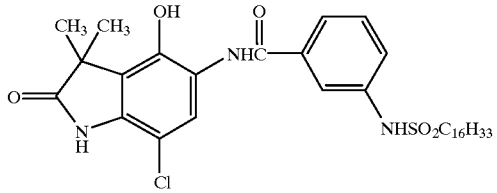

(ADF-8)

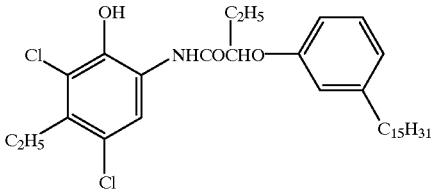

(ADF-9)

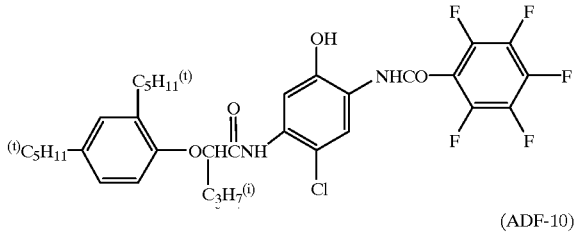

(ADF-10)

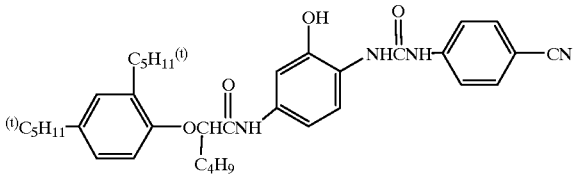

The use of the color fading preventing agent, competing compound, cyan stain preventing agent and phenolic cyan coupler is particularly preferred since the synergistic effect can be obtained rather than achievement of the individual purpose of color fading prevention, color mixing prevention, cyan stain prevention or improvement in color reproducibility.

In the silver halide color photographic light-sensitive material according to the present invention, other various conventionally known photographic elements and additives can be employed.

For instance, a transmissive type support or reflective type support is used as a support for the photographic material of the present invention. Amount the transmissive type support, a transparent film such as a cellulose triacetate film or a polyethylene terephthalate film, and a polyester film composed of 2,6-naphthalene-dicarboxylic acid (NDCA) and ethylene glycol (EG) or composed of NDCA, terephthalic acid and EG having provided thereon an information recording layer such as a magnetic layer are preferably employed. Of the reflective type supports, a laminate composed of plural water-resistant resin layers such as polyethylene layers or polyester layers and containing a white pigment such as titanium oxide in at least one of the resin layers is preferred.

It is preferred that the water-resistant resin layer contains a fluorescent whitening agent. The fluorescent whitening agent may also be dispersed in a hydrophilic colloid layer of the photographic light-sensitive martial. Preferred fluorescent whitening agents used include benzoxazole series, cumarin series and pyrazoline series compounds. Fluorescent whitening agents of benzoxazolyl naphthalene series and benzoxazolyl stilbene series are more preferably used. The amount of the fluorescent whitening agent to be used is not particularly limited and preferably in a range of from 1 to 100 mg/m$^2$. A mixing ratio of the fluorescent whitening agent to be used in the water-resistant resin layer is preferably from 0.0005 to 3% by weight, and more preferably from 0.001 to 0.5% by weight of the resin.

Further, a transmissive type support and a reflective type support each having provided thereon a hydrophilic colloid layer containing a white pigment may be employed.

Moreover, a support having a mirror plate reflective metal surface or a secondary diffusion reflective metal surface may be used as the reflective type support.

A silver chloride or silver chlorobromide emulsion having a silver chloride content of 95 mol % or more is preferably employed as the silver halide emulsion in the color photographic light-sensitive material of the present invention in view of rapid processing suitability. Further, a silver halide emulsion having a silver chloride content of 98 mol % or more is more preferred. Of these silver halide emulsions, those having a silver bromide localized phase on the surface of silver chloride grain is particularly preferred, since high sensitivity as well as stabilization of photographic characteristics are achieved.

With respect to the reflective type support, silver halide emulsion, heterogeneous metal ion doped in silver halide grain, stabilizer and antifoggant for silver halide emulsion, chemical sensitization (chemical sensitizer), spectral sensitization (spectral sensitizer), cyan coupler, magenta coupler, yellow coupler, emulsified dispersion method of coupler, color image stabilizer (anti-staining agent), color fading preventing agent, dye (colored layer), gelatin, layer construction of photographic material and pH of coated layer, those described in the patents shown in Table 1 and Table 2 below are preferably used in the present invention.

TABLE 1

| Photographic Element | JP-A-7-104448 | JP-A-7-77775 | JP-A-7-310895 |
|---|---|---|---|
| Reflective Type Support | Col. 7, line 12 to Col. 12, line 19 | Col. 35, line 43 to Col. 44, line 1 | col. 5, line 40 to Col. 9, line 26 |
| Silver Halide Emulsion | Col. 72, line 29 to Col. 74, line 18 | Col. 44, line 36 to Col. 46, line 29 | Col. 77, line 48 to Col. 80, line 28 |
| Heterogeneous Metal Ion | Col. 74, lines 19 to 44 | Col. 46, line 30 to Col. 47, line 5 | Col. 80, line 29 to Col. 81, line 26 |
| Stabilizer and Antifoggant | Col. 75, lines 9 to 18 | Col. 47, lines 20 to 29 | Col. 18, line 11 to Col. 31, line 37 (particularly, mercapto heterocyclic compound) |

TABLE 1-continued

| Photographic Element | JP-A-7-104448 | JP-A-7-77775 | JP-A-7-310895 |
|---|---|---|---|
| Chemical Sensitization (Chemical Sensitizer) | Col. 74, line 45 to Col. 75, line 6 | Col. 47, lines 7 to 17 | Col. 81, lines 9 to 17 |
| Spectral Sensitization (Spectral Sensitizer) | Col. 75, line 19 to Col. 76, line 45 | Col. 47, line 30 to Col. 49, line 6 | Col. 81, line 21 to Col. 82, line 48 |
| Cyan Coupler | Col. 12, line 20 to Col. 39, line 49 | Col. 62, line 50 to Col. 63, line 16 | Col. 88, line 49 to Col. 89, line 16 |
| Yellow Coupler | Col. 87, line 40 to Col. 88, line 3 | Col. 63, lines 17 to 30 | Col. 89, lines 17 to 30 |
| Magenta Coupler | Col. 88, line 4 to Col. 89, line 18 | Col. 63, line 31 to Col. 64, line 11 | Col. 32, line 34 to Col. 77, line 44 and Col. 88, lines 32 to 46 |
| Emulsified Dispersion Method of Coupler | Col. 71, line 3 to Col. 72, line 11 | Col. 61, lines 36 to 49 | Col. 87, lines 35 to 48 |

TABLE 2

| Photographic Element | JP-A-7-104448 | JP-A-7-77775 | JP-A-7-310895 |
|---|---|---|---|
| Color Image Stabilizer (Anti-staining Agent) | Col. 39, line 50 to Col. 70, line 9 | Col. 61, line 50 to Col. 62, line 49 | Col. 87, line 49 to Col. 88, line 48 |
| Color Fading Preventing Agent | Col. 70, line 10 to Col. 71, line 2 | | |
| Dye (Colored Layer) | Col. 77, line 42 to Col. 78, line 41 | Col. 7, line 14 to Col. 19, line 42 and Col. 50, line 3 to Col. 51, line 14 | Col. 9, line 27 to Col. 18, line 10 |
| Gelatin | Col. 78, line 42 to 48 | Col. 51, lines 15 to 20 | Col. 83, lines 13 or 19 |
| Layer Construction of Photographic Material | Col. 39, lines 11 to 26 | Col. 44, lines 2 to 35 | Col. 31, lines 38 to Col. 32, line 33 |
| pH of Coated Layer | Col. 72, lines 12 to 28 | | |
| Scanning Exposure | Col. 76, line 6 to Col. 77, line 41 | Col. 49, line 7 to Col. 50, line 2 | Col. 82, line 49 to Col. 83, line 12 |
| Preservative in Developing Solution | Col. 88, line 19 to Col. 89, line 22 | | |

The cyan couplers, magenta couplers and yellow couplers which can be suitably employed in the present invention also include those described in JP-A-62-215272, page 91 right upper column, line 4 to page 121, left upper column, line 6, JP-A-2-33144, page 3, right upper column, line 14 to page 18, left upper column, last line and page 30, right upper column, line 6 to page 35, right lower column, line 11, and EP-A-355660, page 4, lines 15 to 27, page 5, line 30 to page 28, last line, page 45, lines 29 to 31 and page 47, line 23 to page 63, line 50.

The bactericides and anti-mold agents described in JP-A-63-271247 are suitably used in the present invention.

Gelatin is preferably employed as a hydrophilic colloid in a photographic layer constituting the photographic light-sensitive material according to the present invention. An amount of heavy metal, for example, iron, copper, zinc or manganese, which is included as an impurity in gelatin, is preferably not more than 5 ppm, more preferably not more than 3 ppm.

The silver halide photographic light-sensitive material according to the present invention is suitable for a scanning exposure system using a cathode ray tube (CRT) in addition to a conventional printing system using a negative printer.

An exposure device using a cathode ray tube is simple, compact and low-cost in comparison with an exposure device using a laser beam. Also, the former is advantageous in view of easy control of an optical axis and color.

In the cathode ray tube used for the image exposure, various light emitting materials which emit light in the visible spectra are employed depending on the demand. For instance, a red light emitting material, a green light emitting material and a blue light emitting material are used individually or in a combination of two or more thereof. The light emitting materials are not limited to those of red, green and blue described above, and other light emitting materials which emit yellow light, orange light, purple light or infrared light may also be utilized. Particularly, a cathode ray tube using a combination of these light emitting materials to emit white light is frequently employed.

When the photographic light-sensitive material having a plural of light-sensitive layers each having a different spectral sensitivity and the cathode ray tube having a plural of light emitting materials each emitting light having a different spectrum are used, a plural of color image signals are input to the cathode ray tube to emit the respective light and a plural of colors are exposed at once. Alternatively, a successive exposure method wherein each color light is emitted according to the input of the corresponding image signal, in order, and filters which cut color light other than the desired color light are used can be adopted. In general, the successive exposure method is preferred to obtain high quality images, since a cathode ray tube of high resolving power can be used.

The photographic light-sensitive material of the present invention can preferably be used in digital scanning exposure system using monochromatic high density light, such as a gal laser, a light emitting diode, a semiconductor laser, a second harmonic generation light source (SHG) comprising a combination of nonlinear optical crystal with a semiconductor laser or a solid state laser using a semiconductor laser as an excitation light source. For obtaining a compact and inexpensive system, it is preferred to use a semiconductor laser, or a second harmonic generation light source (SHG) comprising a combination of nonlinear optical crystal with a semiconductor laser or a solid state laser. In particular, for designing a compact and inexpensive apparatus having a longer duration of life and high stability, it is preferred to use a semiconductor laser, and at least one of exposure light sources should be a semiconductor laser.

When such a scanning exposure light source is used, the spectral sensitivity maximum of the photographic light-sensitive material of the present invention can be appropriately set according to the wavelength of the scanning exposure light source to be used. As an oscillation wavelength of a laser can be made half using an SHG light source comprising a combination of non-linear optical crystal with a solid state laser using a semiconductor laser as an excitation light source or a semiconductor laser, blue light and green light can be obtained. Accordingly, it is possible to have the spectral sensitivity maximum of the photographic light-sensitive material in normal three regions of blue, green and red.

The exposure time in the scanning exposure is defined as the time necessary to expose the pixel size with the pixel density being 400 dpi, and preferred exposure time is $10^{-4}$ second or less and more preferably $10^{-6}$ second or less.

Preferred scanning exposure systems suitable for use in the present invention are described in detail in the patents set forth in the table shown above.

In order to process the silver halide photographic light-sensitive material of the present invention, processing elements and processing methods described in JP-A-2-207250, page 26, right lower column, line 1 to page 34, right upper column, line 9 and JP-A-4-97355, page 5, left upper column, line 17 to page 18, right lower column, line 20 are preferably employed. As preservatives in developing solution, the compounds described in the patent set forth in the table shown above are preferably employed.

In order to conduct development processing of the photographic light-sensitive material according to the present invention after imagewise exposure, a wet type developing process, for example, a developing method using a conventional developing solution containing an alkaline agent and a developing agent, and an activator method in which a photographic light-sensitive material containing a developing agent is developed with an activator solution such as an alkaline solution containing no developing agent, as well as a dry type developing process without using a processing solution, for example, a heat developing method can be employed. Particularly, the activator method is preferred since the processing solution does not contain a developing agent, thus the control and handling of the processing solution are easy. Also, it is favorable in view of the environmental conservation since a load for treatment of the waste solution is small.

The developing agents and precursors thereof which can be incorporated into the photographic light-sensitive material used in the activator method are preferably hydrazine series compounds described, for example, in Japanese Patent Application Nos. 7-63572, 7-334190, 7-334192, 7-334197 and 7-344396.

Further, a developing method wherein the photographic light-sensitive material having a reduced coating amount of silver is subjected to an image amplification process (intensification process) using hydrogen peroxide is preferably employed. In particular, it is preferred to apply this method to the activator method. Specifically, an image forming method using the activator solution containing hydrogen peroxide as described in Japanese Patent Application Nos. 7-63587 and 7-334202 is preferably employed.

According to the activator method, the photographic material is ordinarily subjected to a desilvering treatment after the treatment with the activator solution. However, in the image amplification process using the photographic material having a reduced coating among of silver, the desilvering treatment is omitted and a simple treatment such as washing with water or stabilizing treatment is conduced. Further, in a system wherein an image information is read from a photographic material by a scanner, the processing method omitting the desilvering treatment can be adopted, even when a photographic light-sensitive material having a large coating amount of silver such as a photographic light-sensitive martial for photographing is processed.

Processing elements and processing methods for the activator treatment, desilvering (bleaching/fixing), water washing and stabilizing used in the present invention include those known in the art. Preferably, those described in *Research Disclosure*, September 1994, Item 36544, pages 536 to 541 and Japanese Patent Application No. 7-63572 are employed The silver halide color photographic light-sensitive material according to the present invention has an excellent color forming property to provide a color image of high maximum color density and good color reproducibility.

The present invention will be explained in grater detail with reference to the following examples, but the present invention should not be construed as being limited thereto.

EXAMPLE 1

Preparation of Sample 101

On a cellulose triacetate film support, were provided photographic constituent layers shown below to prepare Sample 101. A coating solution for first layer was prepared in the following manner.

Preparation of Coating Solution for First Layer 1.0 g of Cyan Coupler (1) according to the present invention, 2.0 g of Cyclic Imide Compound (A-1) according to the present invention and 2.0 g of tris(isopropylphenyl) phosphate were added to 10.0 ml of ethyl acetate to completely dissolve. The ethyl acetate solution of coupler was added to 42 g of a 10% aqueous gelatin solution containing 5 g/liter of sodium dodecylbenzenesulfonate and the mixture was emulsified and dispersed by a homogenizer. To the emulsified dispersion was added distilled water to make the total amount of 100 g. 100 g of the resulting emulsified dispersion was mixed with a red-sensitive silver halide emulsion having a high silver chloride content (silver bromide content: 0.6 mol %, and containing the red-sensitive Sensitizing Dye G shown below in an amount of $1.1\times10^{-4}$ mol per mol of silver halide), and the mixture was dissolved to prepare a coating solution for the first layer having the composition described below. As a gelatin hardening agent, 1-oxy-3,5-dichloro-s-triazine sodium salt was used.

Sensitizing Dye G

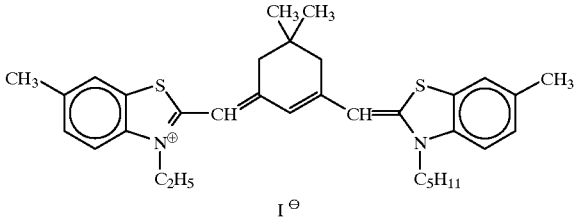

Layer Construction

The composition of each layer is described below.

Support

Cellulose triacetate film

| First Layer (emulsion layer) | |
|---|---|
| Red-Sensitive Emulsion of High Silver Chloride Content | 0.10 g/m$^2$ (in terms of silver) |
| Gelatin | 1.80 g/m$^2$ |
| Cyan Coupler (1) | 0.30 g/m$^2$ |
| Cyclic Imide Compound (A-1) | 0.60 g/m$^2$ |
| Tris(isopropylphenyl) Phosphate | 0.60 g/m$^2$ |
| Second Layer (protective layer) | |
| Gelatin | 1.60 g/m$^2$ |

Preparation of Samples 102 to 115

Samples 102 to 115 were prepared in the same manner as in Sample 101 expect for changing the cyan coupler and cyclic imide compound used in the first layer to those shown in Table 3 below, respectively. Also, in samples 111 and 112, the amounts of the silver halide emulsion and the cyan coupler were changed to two times of those in Sample 101, respectively.

Samples 101 to 115 thus-prepared were evaluated their properties in the following manner.

Evaluation 1: Color Forming Property

Each sample was stored under the condition of 25° C. and 55% RH for 7 days, exposed to red light using a sensitometer (FWH Model, color temperature of a light source: 3200° K., manufactured by Fuji Photo Film Co., Ltd.) through a continuous wedge for sensitometry evaluation, and subjected to development processing according to the processing steps shown below. Then, each sample was subjected to density measurement through a red filter to prepare a sensitometry curve. From the sensitometry curve, the maximum color density ($D_{max}$) was determined. The greater the $D_{max}$, the better the color forming property.

Evaluation 2: Color Reproducibility

With each sample subjected to the development processing, an absorption spectrum was measured by spectrophotometer (UV 365 manufactured by Shimadzu Corporation). From the absorption spectrum, absorbance at 500 nm ($D_{500\ nm}$) was determined when the absorbance at the maximum absorption wavelength was 1.0. The smaller the $D_{500\ nm}$, the less is the absorption in a wavelength region which deteriorates cyan color reproduction, and the color reproducibility is improved.

| Processing Step | Processing Temperature (° C.) | Processing Time (sec) |
|---|---|---|
| Color Development | 38 | 30 |
| Bleach-Fixing | 35 | 45 |
| Rinsing (1) | 35 | 30 |
| Rinsing (2) | 35 | 30 |
| Rinsing (3) | 35 | 30 |
| Drying | 80 | 60 |

Rinsing was conducted in a 3-tank countercurrent system from rinsing (3) to rinsing (1).

The composition of each processing solution was as follows.

| Color Developing Solution | |
|---|---|
| Water | 800 ml |
| Ethylenediamine-N,N,N',N'-tetramethylenephosphonic Acid | 3.0 g |
| Triethanolamine | 8.0 g |
| Potassium Chloride | 3.1 g |
| Potassium Bromide | 0.015 g |
| Potassium Carbonate | 25 g |
| Hydrazinodiacetic Acid | 5.0 g |
| N-Ethyl-N-(β-methanesulfonamidoethyl)-3-methyl-4-aminoaniline Sulfate | 5.0 g |
| Fluorescent Brightening Agent (WHITEX 4, manufactured by Sumitomo Chemical Co., Ltd.) | 2.0 g |
| Water to make | 1,000 ml |
| pH (adjusted with potassium hydroxide) | 10.05 |
| **Bleach-Fixing Solution** | |
| Water | 400 ml |
| Ammonium Thiosulfate (700 g/liter) | 100 ml |
| Ammonium Sulfite | 45 g |
| Ammonium Ethylenediaminetetraacetato Ferrate | 55 g |
| Ethylenediaminetetraacetic Acid | 3 g |
| Ammonium Bromide | 30 g |

-continued

| | |
|---|---|
| Nitric Acid (67%) | 27 g |
| Water to make | 1,000 ml |
| pH | 5.8 |

Rinsing Solution

Ion Exchange Water (each concentration of calcium and magnesium is 3 ppm)

The results obtained are shown in Table 3 below.

TABLE 3

| Sample No. | Cyan Coupler | Cyclic Imide Compound and/or Additive | $D_{max}$ | $D_{500\ nm}$ | Remarks |
|---|---|---|---|---|---|
| 101 | (1) | (A-1) | 2.59 | 0.09 | Present Invention |
| 102 | (1) | (A-2) | 2.58 | 0.11 | Present Invention |
| 103 | (7) | (A-3) | 2.58 | 0.10 | Present Invention |
| 104 | (1) | A 1/1 mixture of (A-1) and Carboxylic Acid Compound (C-1) | 2.63 | 0.07 | Present Invention |
| 105 | (2) | (B-1) | 2.60 | 0.08 | Present Invention |
| 106 | (20) | (B-2) | 2.58 | 0.07 | Present Invention |
| 107 | (1) | (B-5) | 2.57 | 0.07 | Present Invention |
| 108 | (3) | A 1/1 mixture of (B-1) and Carboxylic Acid Compound (C-2) | 262 | 0.08 | Present Invention |
| 109 | (1) | (D-1) | 2.57 | 0.10 | Present Invention |
| 110 | (4) | A 1/1 mixture of (D-2) and Carboxylic Acid Compound (C-2) | 2.63 | 0.09 | Present Invention |
| 111 | Comparative Coupler 2 | (B-1) | 2.59 | 0.19 | Comparison |
| 112 | A 1/1 mixture of Comparative Coupler 3 and Comparative Coupler | (A-1) | 2.56 | 0.19 | Comparison |
| 113 | Comparative Coupler 5 | Comparative Additive | 2.60 | 0.17 | Comparison |
| 114 | (1) | — | 2.51 | 0.17 | Comparison |
| 115 | (1) | Comparative Additive 1 | 2.53 | 0.16 | Comparison |

Comparative Coupler 2

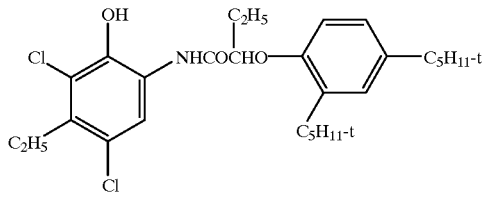

Cyan Coupler (C-2) described in JP-A-62-175748

Comparative Coupler 3

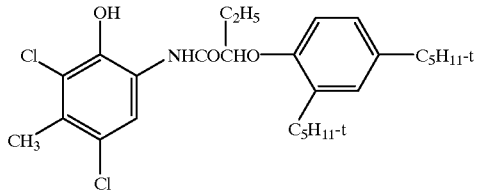

Cyan Coupler described in JP-A-2-96152

Comparative Coupler 4

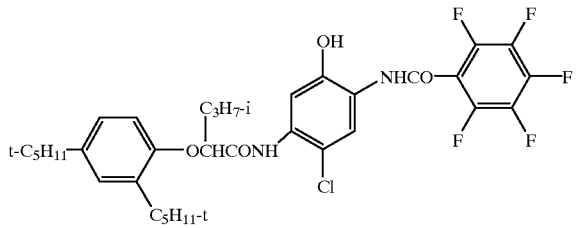

Cyan Coupler described in JP-A-2-96152

Comparative Coupler 5

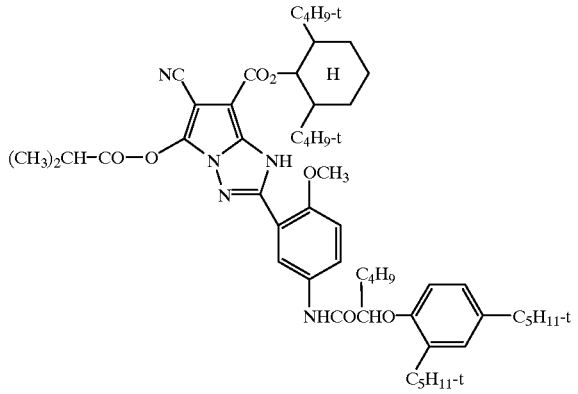

Cyan Coupler No. 41 described in JP-A-7-270990

Comparative Additive 1

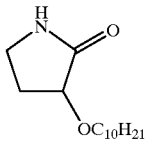

Compound S-91 described in JP-A-7-270990

Comparative Additive 2

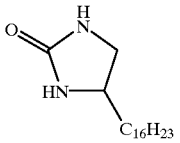

Compound S-107 described in JP-A-7-270990

From the results shown in Table 3, it can be seen that the color reproducibility is remarkably improved without degradation of the color forming property of the cyan coupler by using the cyan coupler according to the present invention together with the cyclic imide compound according to the present invention. It is also apparent that the above described effect is more remarkable when the carboxylic acid compound coexists with the cyclic imide compound according to the present invention.

EXAMPLE 2

A surface of a paper support laminated with polyethylene on both sides was subjected to a corona discharge treatment. On the surface subjected to the corona discharge treatment was provided a gelatin undercoat layer containing sodium dodecylbenzenesulfonate, and various photographic constituent layers described below were coated thereon to prepare a silver halide multilayer color photographic printing paper designated Sample 201. Coating solutions of the layer were prepared as follows.

Preparation of Coating Solution for Fifth Layer:

100 g of Cyan Coupler (1) according to the present invention, 145 g of Cyclic Imide Compound (A-1) according to the present invention and 145 g of Solvent (Solv-9) were dissolved in 100 ml of ethyl acetate and the solution was emulsified and dispersed in 1,000 ml of a 10 % aqueous gelated solution containing 30 g of sodium dodecylbenzenesulfonate to prepare Emulsified Dispersion C.

Separately, Silver Chlorobromide Emulsion C was prepared (a cubic form, a mixture in a ratio of 1/1 (silver mol ratio) of a large grain size emulsion having an average grain size of 0.55 $\mu$m and a small grain size emulsion having an average grain size of 0.45 $\mu$m, variation coefficients of the grain size distribution being 0.09 and 0.11, respectively, both of them being composed of silver chloride substrate grains having 0.8 mol % of silver bromide localized in a part of their surface). The red-sensitive Sensitizing Dyes G and H shown below were added each in an amount of $5.0\times10^{-5}$ mol per mol of silver to the large grain size emulsion, and each in an amount of $8.0\times10^{-5}$ mol per mol of silver to the small grain size emulsion. The silver chlorobromide emulsion was optimally subjected to chemical ripening by adding a sulfur sensitizer and a gold sensitizer.

Emulsified Dispersion C described above was mixed with Silver Chlorobromide Emulsion C and the mixture was dissolved to prepare a coating solution for the fifth layer having the composition shown below. A coating amount of the silver halide emulsion is indicated by the coating amount in terms of silver.

The coating solutions for the first to seventh layers other than the fifth layer were prepared in a manner similar to the coating solution for the fifth layer. 1-Oxy-3,5-dichloro-s-triazine sodium salt was used as a gelatin hardening agent in each layer.

Further, Cpd-11 and Cpd-12 were added to each layer so that the total coating amount became 25.0 mg/m$^2$ and 50.0 mg/m$^2$, respectively.

The cubic silver chlorobromide emulsion used in each light-sensitive emulsion layer was prepared in the same manner as for Sliver Chlorobromide Emulsion C described above while appropriately adjusting the grain size of large grain size emulsion and small grain size emulsion. The spectral sensitizing dyes used for the silver chlorobromide emulsions are shown below.

Sensitizing Dyes for Blue-Sensitive Emulsion Layer:

Sensitizing Dye A

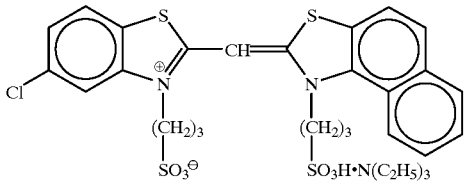

Sensitizing Dye B

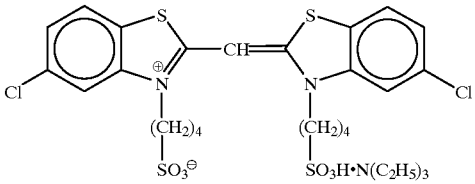

Sensitizing Dye C

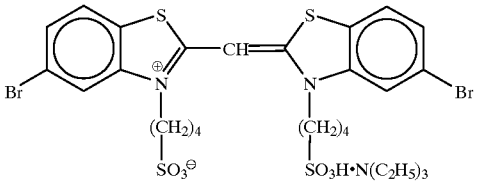

(each was used in an amount of $1.4\times10^{-4}$ mol per mol of the silver halide for the large grain size emulsion and in an amount of $1.7\times10^{-4}$ mol per mol of the silver halide for the small grain size emulsion)

Sensitizing Dyes for Green-Sensitive Emulsion Layer:

Sensitizing Dye D

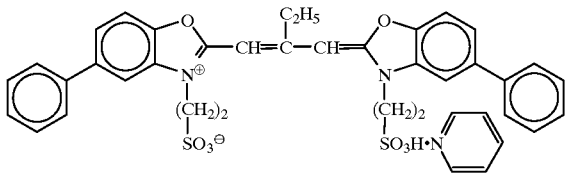

Sensitizing Dye E

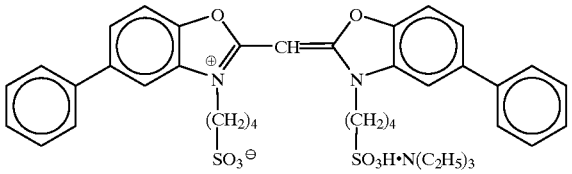

Sensitizing Dye F

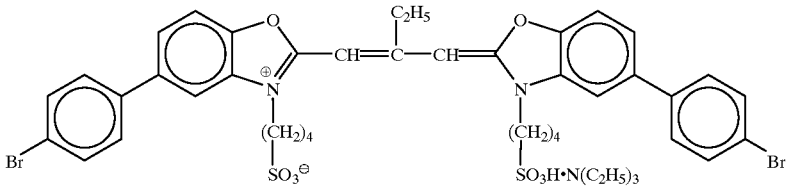

(Sensitizing Dye D was used in an amount of $3.0\times10^{-4}$ mol per mol of the silver halide for the large grain size emulsion and in an amount of $3.6\times10^{-4}$ mol per mol of the silver halide for the small grain size emulsion; Sensitizing Dye E was used in an amount of $4.0\times10^{-5}$ mol per mol of the silver halide for the large grain size emulsion and in an amount of $7.0\times10^{-5}$ mol per mol of the silver halide for the small grain size emulsion; and Sensitizing Dye F was used in an amount of $2.0\times10^{-4}$ mol per mol of the silver halide for the large grain size emulsion and in an amount of $2.8\times10^{-4}$ mol per mol of the silver halide for the small grain size emulsion).

Sensitizing Dyes for Red-Sensitive Emulsion Layer:

Sensitizing Dye G

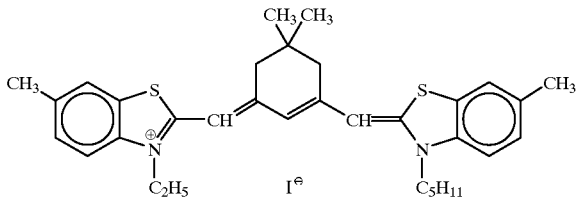

Sensitizing Dye H

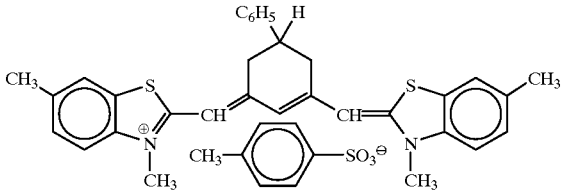

(each was used in an amount of $5.0\times10^{-5}$ mol per mol of the silver halide for the large grain size emulsion and in an amount of $8.0\times10^{-5}$ mol per mol of the silver halide for the small grain size emulsion.)

Further, Additive X shown below was added to the red-sensitive emulsion layer in an amount of $2.6\times10^{-3}$ mol per mol of silver halide.

Additive X

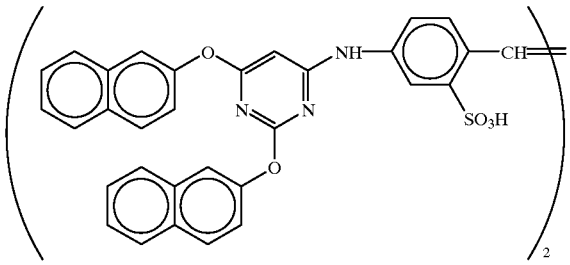

Further, 1-(5-methylureidophenyl)-5-mercaptotetrazole was added to the blue-sensitive emulsion layer, the green-sensitive emulsion layer and the red-sensitive emulsion layer in an amount of $3.5\times10^{-4}$ mol, $3.0\times10^{-3}$ mol and $2.5\times10^{-4}$ mol, respectively, per mol of the silver halide.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes (in the parentheses, the coating amounts thereof being shown) were added to the emulsion layers for the purpose of preventing irradiation.

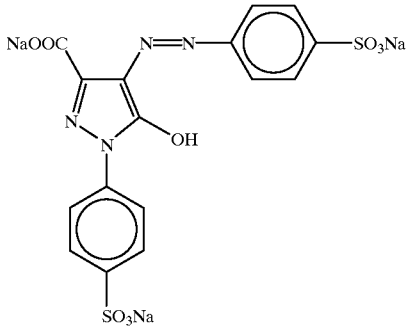

(10 mg/m$^2$)

-continued

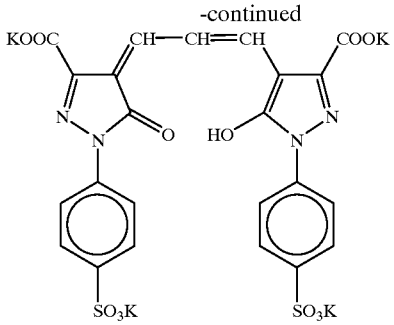

(10 mg/m$^2$)

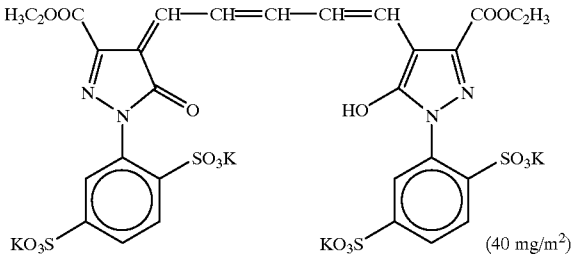

(40 mg/m$^2$)

and

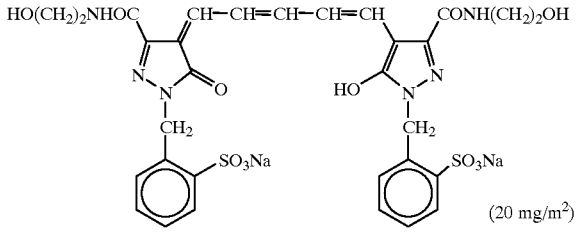

(20 mg/m$^2$)

Layer Construction

The composition of each layer is described below. The numeral represents the coating amount (g/m$^2$). The numeral for silver halide emulsion represents the coating amount in terms of silver.

Support

Polyethylene-laminated paper containing a white pigment ($TiO_2$) in an amount of 15 wt % and a bluish dye (ultramarine) in the polyethylene laminated layer on the side of the first layer.

| First Layer (blue-sensitive emulsion layer) | |
|---|---|
| Silver Chlorobromide Emulsion (a cubic form, a mixture in a ratio of 3/7 (silver mol ratio) of a large grain size emulsion having an average grain size of 0.55 μm, and a small grain size emulsion having an average grain size of 0.41 μm; variation coefficients of the grain size distribution being 0.08 and 0.10, respectively, both of them containing 0.8 mol% of silver bromide localized at a part of the surface of each grain having silver chloride as substrate) | 0.27 |
| Gelatin | 1.36 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.04 |

-continued

| | |
|---|---|
| Solvent (Solv-1) | 0.13 |
| Solvent (Solv-5) | 0.13 |
| Second Layer (color mixing preventing layer) | |
| Gelatin | 1.00 |
| Color Mixing Preventing Agent (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (green-sensitive emulsion layer) | |
| Silver Chlorobromide Emulsion (a cubic form, a mixture in a ratio of 1/3 (silver mol ratio of a large grain size emulsion having an average grain size of 0.55 μm and a small grain size emulsion having an average grain size of 0.39 μm; variation coefficients of the grain size distribution being 0.10 and 0.08, respectively, both of them containing 0.8 mol% of silver bromide localized at a part of the surface of each grain having silver chloride as substrate) | 0.13 |
| Gelatin | 1.45 |
| Magenta Coupler (ExM) | 0.16 |
| Ultraviolet Absorber (Uv-2) | 0.16 |
| Color Image Stabilizer (Cpd-2) | 0.03 |
| Color Image Stabilizer (Cpd-5) | 0.10 |
| Stain Preventing Agent (Cpd-6) | 0.01 |
| Color Image Stabilizer (Cpd-7) | 0.01 |
| Stain Preventing Agent (Cpd-8) | 0.08 |
| Color Image Stabilizer (Cpd-9) | 0.02 |
| Solvent (Solv-3) | 0.13 |
| Solvent (Solv-4) | 0.39 |
| Solvent (Solv-6) | 0.26 |
| Fourth Layer (color mixing preventing layer) | |
| Gelatin | 0.70 |
| Color Mixing Preventing Agent (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (red-sensitive emulsion layer) | |
| Silver chlorobromide Emulsion C | 0.11 |
| Gelatin | 1.45 |
| Cyan Coupler (1) | 0.31 |
| Cyclic Imide Compound (A-1) | 0.45 |
| Solvent (Solv-9) | 0.45 |
| Sixth Layer (ultraviolet absorbing layer) | |
| Gelatin | 0.60 |
| Ultraviolet Absorber (UV-1) | 0.39 |
| Color Image Stabilizer (Cpd-5) | 0.01 |
| Color Image Stabilizer (Cpd-7) | 0.05 |
| Solvent (Solv-7) | 0.05 |
| Seventh Layer (protective layer) | |
| Gelatin | 1.00 |
| Acryl-Modified Copolymer of Polyvinyl Alcohol (modification degree: 17%) | 0.05 |
| Liquid Paraffin | 0.02 |
| Surface Active Agent (Cpd-10) | 0.01 |

The compounds used for preparing the composition of each layer described above are shown below.

(ExY) Yellow Coupler

A 1/1 mixture by mol ratio of

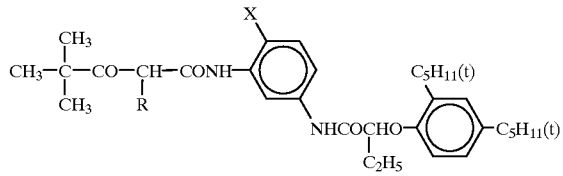

R =

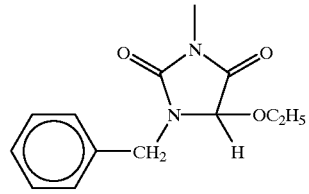

X = Cl and

R =

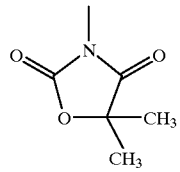

X = $OCH_3$ (ExM) Magenta Coupler

A 1/1 mixture by mol ratio of

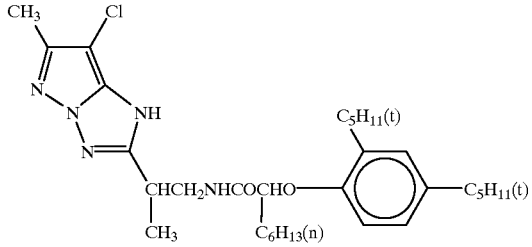

and

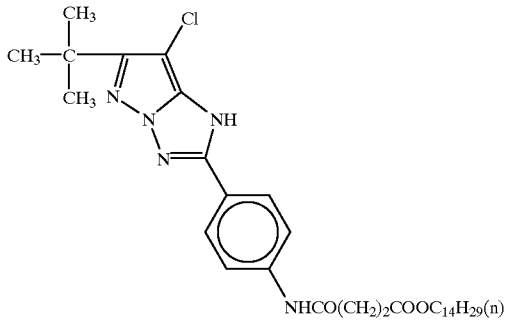

(Cpd-1) Coupler Image Stabilizer

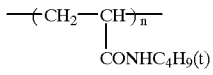

number average molecular weight: 60,000

(Cpd-2) Color Image Stabilizer
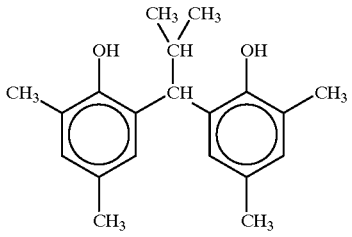
(Cpd-3) Color Image Stabilizer
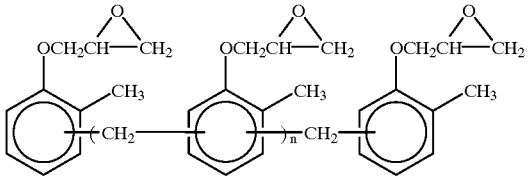
n=7 to 8 (average value)
(CPd-4) Color Mixing Preventing Agent
A 1/1/1 mixture by weight ratio of
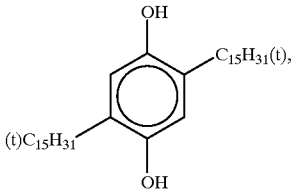
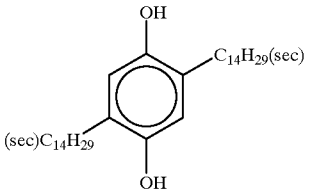
and
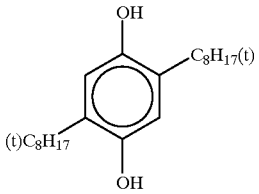
(Cpd-5) Color Image Stabilizer
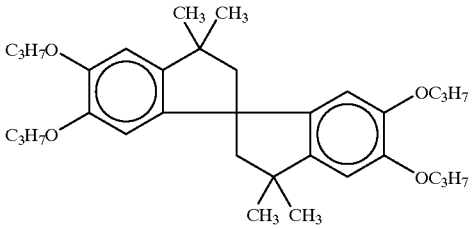
(Cpd-6) Stain Preventing Agent
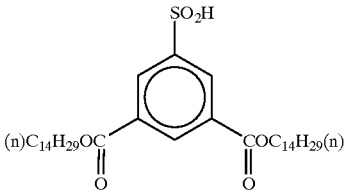
(Cpd-7) Color Image Stabilizer
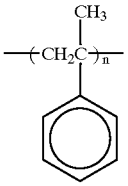
number average molecular weight: 600
(Cpd-8) Stain Preventing Agent
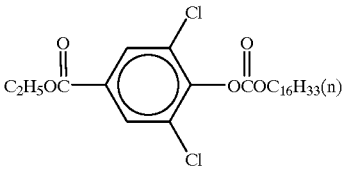
(Cpd-9) Color Image Stabilizer
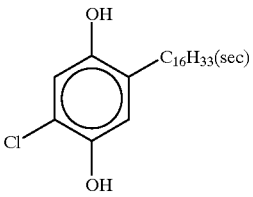

(Cpd-10) Surface Active Agent
A 1/1/1 mixture by-weight of
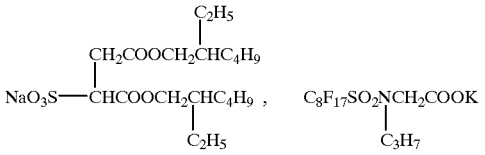
and
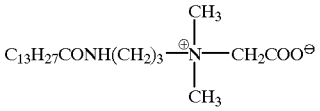
(Cpd-11) Preservative
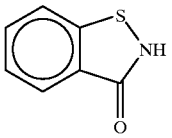
(Cpd-12) Preservative
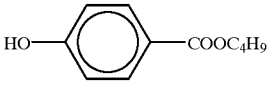
(Cpd-13) Surface Active Agent
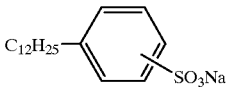
(UV-1) Ultraviolet Absorber
A 1/3/1/3 mixture by weight ratio of
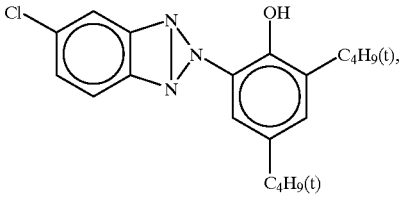
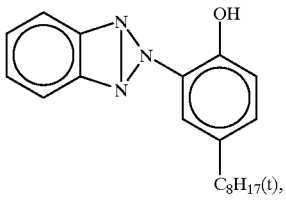
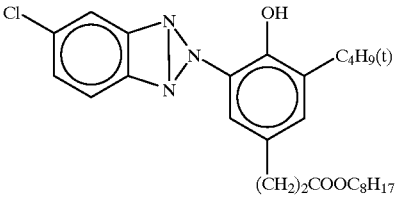
and
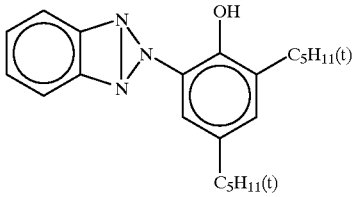
(UV-2) Ultraviolet Absorber
A 2/3/4 mixture by weight ratio of
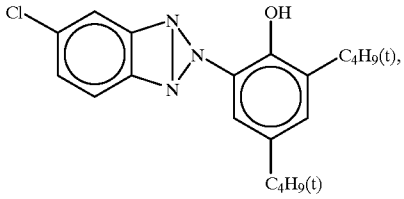
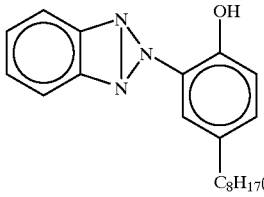
and
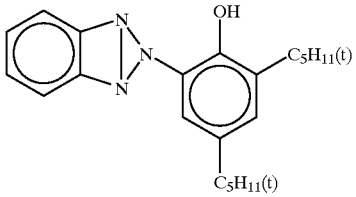
(Solv-1) Solvent
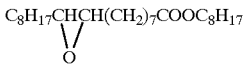
(Solv-2) Solvent
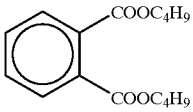
(Solv-3) Solvent
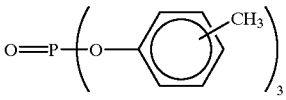
(Solv-4) Solvent
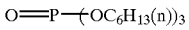
(Solv-5) Solvent
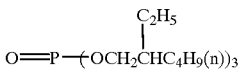
(Solv-6) Solvent
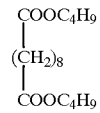

-continued (Solv-7) Solvent

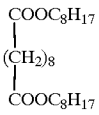

(Solv-8) Solvent

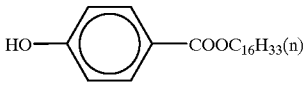

(Solv-9) Solvent

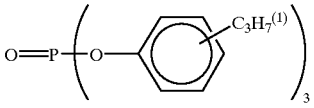

Preparation of Samples 202 to 218

Samples 202 to 218 were prepared in the same manner as in Sample 201 expect for changing the cyan coupler, cyclic imide compound and high boiling point organic solvent used in the fifth layer to those shown in Table 4 below, respectively. Also, in Samples 213 and 214, the amounts of the silver halide and the cyan coupler were changed to two times of those in Sample 201, respectively.

The samples thus-prepared were stored under the condition of 25° C. and 55% RH for 7 days and subjected to the following evaluation.

Sample 201 was rolled into a 127 mm width and subjected to imagewise exposure and continuous processing (running test) through the following processing steps using a printer processor (PP1820V manufactured by Fuji Photo Film Co., Ltd.) until the replenishing amount reached two times the tank volume of the color developing solution.

| Processing Step | Temperature (° C.) | Time (sec.) | Replenishing Amount* (ml) |
|---|---|---|---|
| Color development | 38.5 | 45 | 73 |
| Bleach-fixing | 35 | 45 | 60** |
| Rinsing (1) | 35 | 30 | — |
| Rinsing (2) | 35 | 30 | — |
| Rinsing (3) | 35 | 30 | 360 |
| Drying | 80 | 60 | |

*Replenishing amount was per 1 $m^2$ of photographic material.
**In addition to 60 ml as shown above, 120 ml was flowed in from Rinsing (1) per 1 $m^2$ of photographic material.

(The rinsing was in a 3-tank countercurrent system from Rinsing (3) to Rinsing (1).)

Each processing solution had the following composition.

| Color Developing Solution | Tank Solution | Replenisher |
|---|---|---|
| Water | 800 ml | 800 ml |
| Ethylenediaminetetra-acetic Acid | 3.0 g | 3.0 g |
| Disodium 4,5-dihydroxy benzene-1,3-disulfonate | 0.5 g | 0.5 g |
| Triethanolamine | 12.0 g | 12.0 g |
| Potassium Chloride | 6.5 g | — |
| Potassium Bromide | 0.03 g | — |
| Potassium carbonate | 27.0 g | 27.0 g |
| Fluorescent Brightening Agent (WHITEX 4, manufactured by Sumitomo Chemical Co., Ltd.) | 1.0 g | 3.0 g |
| Diethylhydroxylamine | 2.0 g | 4.0 g |
| Sodium Sulfite | 0.1 g | 0.1 g |
| Disodium-N,N-bis(sulfonato ethyl)hydroxylamine | 5.0 g | 10.0 g |
| Sodium Triisopropyl naphthalene (β) sulfonate | 0.1 g | 0.1 g |
| N-Ethyl-N-(β-methanesulfon-amidoethyl)-3-methyl-4-amino-aniline 3/2 Sulfuric Acid Monohydrate | 5.0 g | 11.5 g |
| Water to make | 1,000 ml | 1,000 ml |
| pH (25° C., adjusted with potassium hydroxide and sulfuric acid) | 10.00 | 11.00 |
| Water | 600 ml | 150 ml |
| Ammonium Thiosulfate (750 g/liter) | 93 ml | 230 ml |
| Ammonium Sulfite | 40 g | 100 g |
| Ammonium Ethylenediamine-tetraacetato Ferrate | 55 g | 135 g |
| Ethylenediaminetetraacetic Acid | 5 g | 12.5 g |
| Nitric Acid (67%) | 30 g | 65 g |
| Water to make | 1,000 ml | 1,000 ml |
| pH (25° C., adjusted with acetic acid and aqueous ammonia) | 5.8 | 5.6 |

Rinsing Solution (tank solution and replenisher were the same)

| | |
|---|---|
| Sodium Chlorinated Isocyanurate | 0.02 g |
| Deionized Water (electric conductivity: 5 μs/cm or less) | 1,000 ml |
| pH | 6.5 |

Each of Samples 201 to 218 was subjected to stepwise exposure using a sensitometer (FWH Model, color temperature of a light source: 3200 K manufactured by Fuji Photo Film Co., Ltd.) through a red filter and development processing using the running solutions described above.

With each sample thus-processed, the $D_{max}$ and $D_{500\ nm}$ were determined in the same manner as in Example 1. The results obtained are shown in Table 4 below.

From the results shown in Table 4, it can be seen that the color reproducibility is remarkably improved without deterioration of the color forming property of the cyan coupler by using the cyan coupler according to the present invention together with the cyclic imide compound according to the present invention. It is also apparent that the above described effect is more remarkable when the carboxylic acid compound coexists with the cyclic imide compound according to the present invention.

TABLE 4

| Sample No. | Cyan Coupler | Carboxylic Acid Compound and/or Additive | High Boiling Point Organic Solvent | $D_{max}$ | $D_{500\ nm}$ | Remarks |
|---|---|---|---|---|---|---|
| 201 | (1) | (A-1) | Solv-9 | 2.54 | 0.09 | Present Invention |
| 202 | (2) | (A-2) | Solv-4 | 2.54 | 0.10 | Present Invention |
| 203 | (4) | (A-4) | Solv-5 | 2.53 | 0.10 | Present Invention |
| 204 | (1) | A 1/1 mixture of (A-1) and Carboxylic Acid Compound (C-1) | Solv-9 | 2.57 | 0.07 | Present Invention |
| 205 | (1) | (B-1) | Solv-3 | 2.54 | 0.09 | Present Invention |
| 206 | (1) | (B-2) | Solv-5 | 2.53 | 0.09 | Present Invention |
| 207 | (7) | (B-5) | Solv-5 | 2.54 | 0.10 | Present Invention |
| 208 | (25) | A 1/1 mixtute of (B-1) and Carboxylic Acid Compound (C-2) | Solv-9 | 2.56 | 0.07 | Present Invention |
| 209 | (1) | (D-1) | Solv-3 | 2.54 | 0.09 | Present Invention |
| 210 | (1) | (D-3) | Solv-3 | 2.53 | 0.10 | Present Invention |
| 211 | (10) | (D-5) | Solv-5 | 2.52 | 0.11 | Present Invention |
| 212 | (11) | A 1/1 mixture of (D-1) and Carboxylic Acid Compound (AC-4) | Solv-9 | 2.56 | 0.08 | Present Invention |
| 213 | Comparative Coupler 2 | (A-1) | Solv-3 | 2.46 | 0.20 | Comparison |
| 214 | A 1/1 mixture of Comparative Coupler 3 and Comparative Coupler 4 | (B-1) | Solv-4 | 2.47 | 0.21 | Comparison |
| 215 | Comparative Coupler 5 | Comparative Additive 1 | Solv-4 | 2.53 | 0.18 | Comparison |
| 216 | Comparative Coupler 5 | Comparative Additive 2 | Solv-5 | 2.54 | 0.18 | Comparison |
| 217 | (1) | — | Solv-9 | 2.43 | 0.18 | Comparison |
| 218 | (1) | Comparative Additive 1 | Solv-9 | 2.45 | 0.18 | Comparison |

EXAMPLE 3

A surface of a paper support laminated with polyethylene on both sides was subjected to a corona discharge treatment. On the surface subjected to the corona discharge treatment was provided a gelatin undercoat layer containing sodium dodecylbenzenesulfonate, and various photographic constituent layers described below were coated thereon to prepare a silver halide multilayer color photographic printing paper designated Sample 301. Coating solutions of the layers were prepared as follows.

Preparation of Coating Solution for Fifth Layer:

190 g of Cyan Coupler (1) according to the present invention, 128 g of Cyclic Imide Compound (A-1) according to the present invention, 25 g of High Boiling Point Organic Solvent (SA-1), 170 ml of Solvent (Solv-9), 35 g of Competing Compound (ADB-3), 152 g of Color Fading Preventing Agent (ADA-1), 13 g of Color Image Stabilizer (ADF-4), 13 g of Color Image Stabilizer (ADF-5), 63 g of Color Image Stabilizer (Cpd-14), 127 g of Color Image Stabilizer (Cpd-18), 76 g of Carboxylic Acid Compound (C-1), 10 g of Stain Preventing Agent (Cpd-6) and 100 g of Stain Preventing Agent (Cpd-8) were added to 800 ml of ethyl acetate. The ethyl acetate solution was added to 8.7 Kg of a 10% aqueous gelatin solution containing 28.8 g of Surface Active Agent (Cpd-13) and the mixture was emulsified and dispersed to prepare Emulsified Dispersion C' having an average particle size of 0.18 $\mu$m.

Separately, Silver Chlorobromide Emulsion C' was prepared (a cubic form, a mixture in a ratio of 1/4 (silver mol ratio) of a large grain size emulsion having an average grain size of 0.55 $\mu$m and a small grain size emulsion having an average grain size of 0.42 $\mu$m, variation coefficients of the grain size distribution being 0.09 and 0.11, respectively, both of them being composed of silver chloride substrate grains having 0.8 mol % of silver bromide localized in a part of their surface). The red-sensitive Sensitizing Dyes G and H described in Example 2 were added each in an amount of $5.0\times10^{-5}$ mol per mol of silver to the large grain size emulsion, and each in an amount of $8.0\times10^{-5}$ mol per mol of silver to the small grain size emulsion. Further, Additive X described in Example 2 was added in an amount of $2.6\times10^{-3}$ mol per mol of silver halide. The silver chlorobromide emulsion was subjected optimally to chemical ripening by adding a sulfur sensitizer and a gold sensitizer.

Emulsified Dispersion C' described above was mixed with Silver Chlorobromide Emulsion C' and the mixture was dissolved to prepare a coating solution for the fifth layer having the composition shown below. A coating amount of the silver halide emulsion is indicated by the coating amount in terms of silver.

The coating solutions for the first to seventh layers other than the fifth layer were prepared in a manner similar to the coating solution for the fifth layer. These coating solutions were coated 15 minutes after the preparation thereof. 1-Oxy-3,5-dichloro-s-triazine sodium salt was used as a gelatin hardening agent in each layer.

Further, Preservatives AS-1, AS-2, AS-3 and AS-4 shown below were added to each layer so that the total coating amount became 15.0 mg/m$^2$, 6.0 mg/m$^2$, 5.0 mg/m$^2$ and 10.0 mg/m$^2$, respectively.

The cubic silver chlorobromide emulsion used in each light-sensitive emulsion layer was prepared in the same manner as for Silver Chlorobromide emulsion C' described above while appropriately adjusting the grain size of large grain size emulsion and small grain size emulsion. The same spectral sensitizing dyes described in Example 2 were used in the same amounts for the silver chlorobromide emulsions for the blue-sensitive emulsion layer and the green-sensitive emulsion layer, respectively.

Further, 1-(5-methylureidophenyl)-5-mercaptotetrazole was added to the blue-sensitive emulsion layer, the green-sensitive emulsion layer and the red-sensitive emulsion layer in an amount of $3.3\times10^{-4}$ mol, $1.0\times10^{-3}$ mol and $5.9\times10^{-4}$ mol, respectively, per mol of the silver halide. Also, the mercaptotetrazole compound was added to the second layer, the fourth layer, the sixth layer and the seventh layer in an amount of 0.2 mg/m$^2$, 0.2 mg/m$^2$, 0.6 mg/m$^2$ and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of the silver halide.

Moreover, the following dyes were added separately to the second layer, the fourth layer and the sixth layer as irradiation preventing water-soluble dyes.

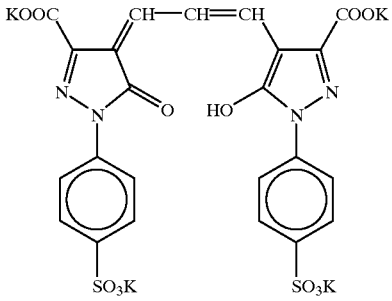

(10 mg/m$^2$)

-continued

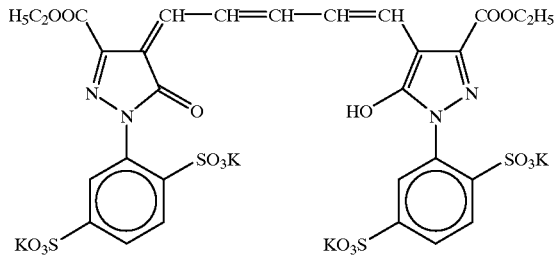

(40 mg/m$^2$)

and

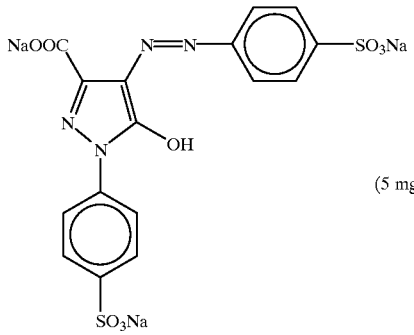

(5 mg/m$^2$)

Layer Construction

The composition of each layer is described below. The numeral represents the coating amount (g/m$^2$). The numeral for silver halide emulsion represents the coating amount in terms of silver.

Support

Polyethylene-laminated paper containing a white pigment ($TiO_2$) in an amount of 15 wt % and a bluish dye (ultramarine) in the polyethylene laminated layer on the side of the first layer.

| | |
|---|---|
| First Layer (blue-sensitive emulsion layer) | |
| Silver Chlorobromide Emulsion (a cubic form, a mixture in a ratio of 3/7 (silver mol ratio) of large grain size emulsin having an average grain size of 0.88 μm and a small grain size emulsion having an average grain size of 0.70 μm; variation coefficients of the grain size distribution being 0.08 and 0.10, respectively, both of them containing 0.3 mol% of silver bromide localized at a part of the surface of each grain having silver chloride as substrate) | 0.26 |
| Gelatin | 1.4 |
| Yellow Coupler (ExY) | 0.64 |
| Color Image Stabilizer (Cpd-1) | 0.078 |
| Color Image Stabilizer (Cpd-2) | 0.038 |
| Color Image Stabilizer (Cpd-3) | 0.085 |
| Color Image Stabilizer (Cpd-5) | 0.020 |
| Color Image Stabilizer (Cpd-15) | 0.0050 |
| Solvent (Solv-1) | 0.11 |
| Solvent (Solv-5) | 0.11 |
| Second Layer (color-mixing preventing layer) | |
| Gelatin | 1.0 |
| Color Mixing Preventing Agent (Cpd-4) | 0.11 |
| Solvent (Solv-1) | 0.065 |

-continued

| | |
|---|---|
| Solvent (Solv-2) | 0.22 |
| Solvent (Solv-3) | 0.080 |
| Solvent (Solv-8) | 0.010 |
| Ultraviolet Absorber (UV-B) | 0.070 |
| Third Layer (green-sensitive emulsion layer) | |
| Silver Chlorobromide Emulsion (a cubic form, a mixture in a ratio of 1/3 (silver mol ratio) of a large grain size emulsin having an average grain size of 0.55 μm and a small grain size emulsion having an average grain size of 0.39 μm; variation coefficients of the grain size distribution being 0.10 and 0.08, respectively, both of them containing 0.7 mol% of silver bromide localized at a part of the surface of each grain having silver chloride as substrate) | 0.11 |
| Gelatin | 1.3 |
| Magenta Coupler (ExM) | 0.13 |
| Ultraviolet Absorber (UV-A) | 0.12 |
| Color Image Stabilizer (Cpd-2) | 0.010 |
| Color Image Stabilizer (Cpd-5) | 0.020 |
| Stain Preventing Agent (Cpd-6) | 0.010 |
| Color Image Stabilizer (Cpd-14) | 0.080 |
| Stain Preventing Agent (Cpd-8) | 0.030 |
| Color Image Stabilizer (Cpd-16) | 0.0020 |
| Solvent (Solv-3) | 0.15 |
| Solvent (Solv-4) | 0.22 |
| Solvent (Solv-6) | 0.11 |
| Fourth Layer (color-mixing preventing layer) | |
| Gelatin | 1.0 |
| Color Mixing Preventing Agent (Cpd-4) | 0.11 |
| Solvent (Solv-1) | 0.065 |
| Solvent (Solv-2) | 0.22 |
| Solvent (Solv-3) | 0.080 |
| Solvent (Solv-8) | 0.010 |
| Ultraviolet Absorber (Uv-B) | 0.070 |
| Fifth Layer (red-sensitive emulsion layer) | |
| Silver Chlorobromide Emulsion (a cubic form, a mixture in a ratio of 1/4 (silver mol ratio) of a large grain size emulsin having an average grain size of 0.55 μm and a small grain size emulsion having an average grain size of 0.42 μm; variation coefficients of the grain size distribution being 0.09 and 0.11, respectively, both of them containing 0.8 mol% of silver bromide localized at a part of the surface of each grain having silver chloride as substrate) | 0.086 |
| Surface Active Agent (Cpd-13) | 0.032 |
| Gelatin | 0.79 |
| Cyan Coupler (1) | 0.15 |
| Solvent (Solv-9) | 0.13 |
| Solvent (SA-1) | 0.02 |
| Cyclic Imide Compound (A-1) | 0.101 |
| Competing Compound (ADB-3) | 0.028 |
| Color Fading Preventing Agent (ADA-1) | 0.12 |
| Color Image Stabilizer (ADF-4) | 0.01 |
| Color Image Stabilizer (ADF-5) | 0.01 |
| Color Image Stabilizer (Cpd-14) | 0.05 |
| Color Image Stabilizer (Cpd-18) | 0.10 |
| Corboxylic Acid Compound (C-1) | 0.06 |
| Color Image Stabilizer (Cpd-6) | 0.008 |
| Color Image Stabilizer (Cpd-8) | 0.079 |
| Sixth Layer (ultraviolet absorbing layer) | |
| Gelatin | 0.63 |
| Ultraviolet Absorber (UV-C) | 0.08 |
| Color Image Stabilizer (Cpd-14) | 0.050 |
| Solvent (Solv-7) | 0.050 |
| Seventh Layer (protective layer) | |
| Acid Treated Gelatin | 1.0 |
| Acryl-Modified Copolymer of Polyvinyl Alcohol (modification degree: 17%) | 0.043 |

-continued

| | |
|---|---|
| Liquid Paraffin | 0.018 |
| Surface Active Agent (Cpd-17) | 0.026 |

The compounds used for preparing the composition of each layer described above are shown below.

(Cpd-14) Color Image Stabilizer

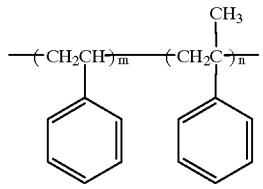

number average molecular weight: 600 m/n=10/90

(Cpd-15) Color Image Stabilizer

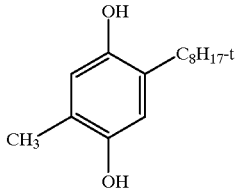

(Cpd-16) Color Image Stabilizer

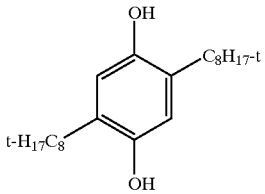

(Cpd-17) Surface Active Agent

A 3/1/3 mixture by weight ratio of (1), (2) and (3)

(1)

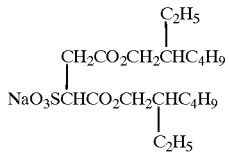

(2)

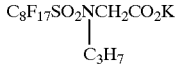

(3)

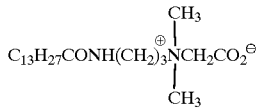

(Cpd-18) Color Image Stabilizer
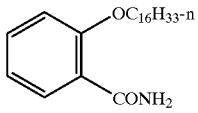
(UV-A) Ultraviolet Absorber
A 5/2/2/1 mixture by weight ratio of (1), (2), (3) and (4)
(1)
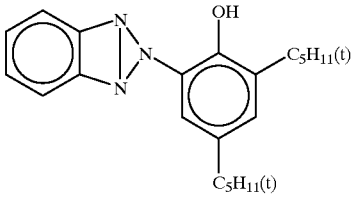
(2)
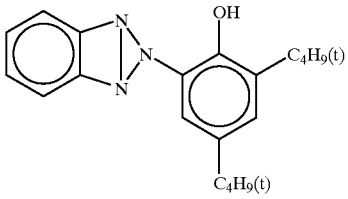
(3)
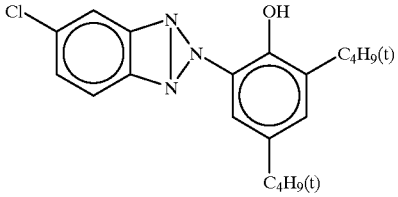
(4)
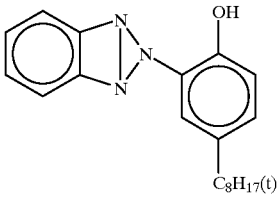
(UV-B) Ultraviolet Absorber
A 5/2/2/2/1 mixture by weight ratio of (1), (2), (3), (4) and (5)
(1)
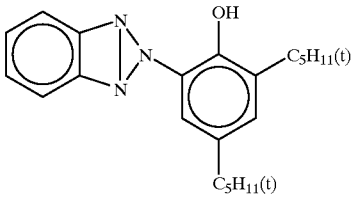
-continued
(2)
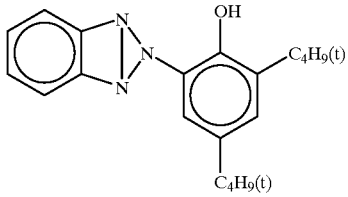
(3)
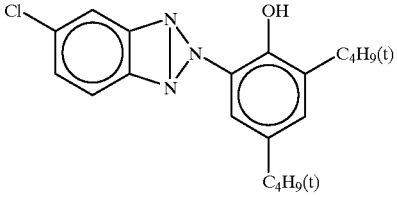
(4)
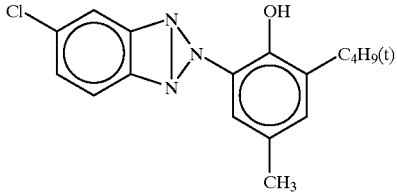
(5)
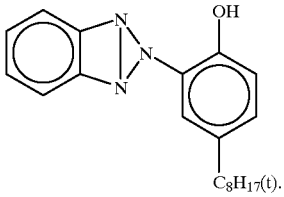
(UV-C) Ultraviolet Absorber
A 6/2/2/2/3/1 mixture by weight ratio of (1), (2), (3), (4), (5) and (6)
(1)
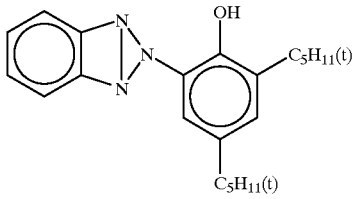

-continued (2)

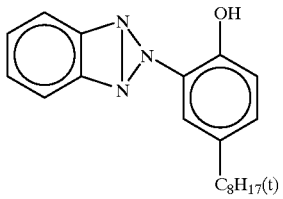

(3)

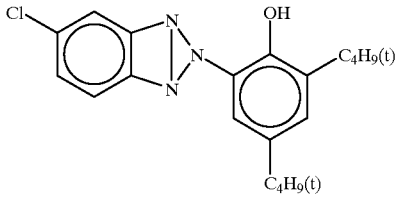

(4)

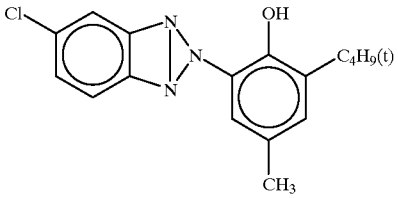

(5)

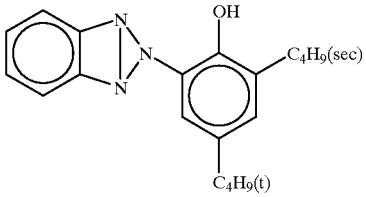

(6)

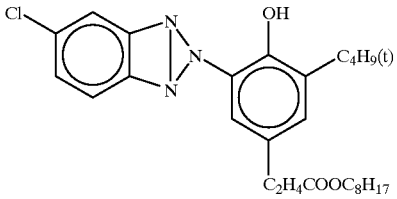

(AS-1) Preservative

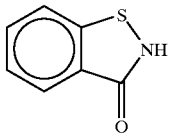

(AS-2) Preservative

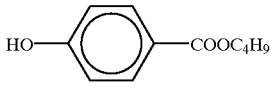

(AS-3) Preservative

A 1/1/1/1 mixture by weight ratio of a, b, c and d

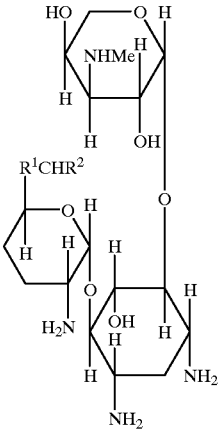

| | $R^1$ | $R^2$ |
|---|---|---|
| a | —Me | —NHMe |
| b | —Me | —$NH_2$ |
| c | —H | —$NH_2$ |
| d | —H | —NHMe |

(AS-4) Preservative

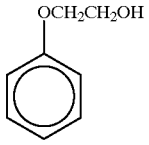

Sample 301 thus-prepared was subjected to the exposure, processing, sensitometry measurement and evaluation in the same manner as in Example 2. As a result, it can be seen that Sample 301 exhibits an excellent color forming property and provides a cyan color image having good color reproducibility.

While the invention has been described in detail and with reference to specific embodiments thereof, it will be apparent to one skilled in the art that various changes and modifications can be made therein without departing from the spirit and scope thereof.

What is claimed is:

1. A silver halide color photographic light-sensitive material comprising a support having provided thereon at least one hydrophilic colloid layer, wherein the silver halide color photographic light-sensitive material contains a coupler represented by the formula (1) shown below and a non-color forming colorless cyclic imide compound having a diffusion-resistant group:

(1)

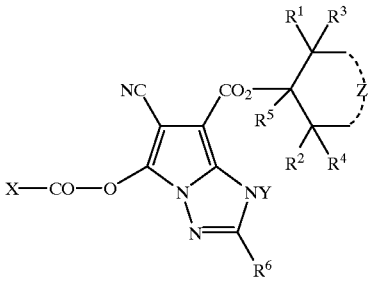

wherein $R^1$ and $R^2$ each represents an alkyl group or an aryl group; $R^3$, $R^4$ and $R^5$ each represents a hydrogen atom, an alkyl group or an aryl group; Z represents a non-metallic atomic group necessary to form a saturated ring; $R^6$ represents a substituent; X represents a heterocyclic group, a substituted amino group or an aryl group; and Y represents a hydrogen atom or a group capable of being released upon color development, wherein said coupler represented by formula (1) and said non-color forming colorless cyclic imide compound having a diffusion resistant group are contained in the same hydrophilic colloidal layer, wherein said non-color forming colorless cyclic imide compound is used in an amount in a range of from 0.1 to 4 parts by weight, per 1 part weight of the coupler represented by the formula (1).

2. A silver halide color photographic light-sensitive material as claimed in claim 1, wherein the non-color forming colorless cyclic imide compound having a diffusion-resistant group is a compound represented by the following formula (D):

(D)

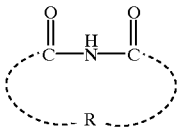

wherein R represents a non-metallic atomic group necessary to form a 5-membered or 6-membered ring together with the —CO—NH—CO— and the 5-membered or 6-membered ring has a diffusion-resistant group having from 8 to 22 carbon atoms as a substituent or a partial structure in a substituent.

3. A silver halide color photographic light-sensitive material as claimed in claim 2, wherein the non-color forming colorless cyclic imide compound having a diffusion-resistant group is a compound represented by the following formula (A):

(A)

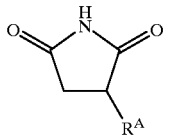

wherein $R^A$ represents a substituted or unsubstituted alkenyl group, a substituted or unsubstituted alkoxy group or a substituted or unsubstituted aryloxy group and $R^A$ is or contains a diffusion-resistant group having from 8 to 22 carbon atoms.

4. A silver halide color photographic light-sensitive material as claimed in claim 1, which further contains a non-color forming colorless carboxylic acid having a diffusion-resistant group or a salt thereof.

5. A silver halide color photographic light-sensitive material as claimed in claim 1, which further contains a high boiling point organic solvent.

6. A silver halide color photographic light-sensitive material as claimed in claim 5, wherein the high boiling point organic solvent is a phosphoric acid ester or an amide.

7. A silver halide color photographic light-sensitive material as claimed in claim 6, wherein the phosphoric acid ester is a compound represented by the following formula (SP):

(SP)

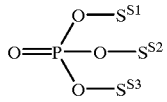

wherein $R^{S1}$, $R^{S2}$ and $R^{S3}$, which may be the same or different, each represents a substituted or unsubstituted alkyl group or a substituted or unsubstituted phenyl group.

8. A silver halide color photographic light-sensitive material as claimed in claim 6, wherein the amide is a compound represented by the following formula (SA):

(SA)

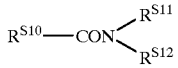

wherein $R^{S10}$, $R^{S11}$, which may be the same or different, each represents a substituted or unsubstituted alkyl group or a substituted or unsubstituted phenyl group; and $R^{S12}$ represents a hydrogen atom, a substituted or unsubstituted alkyl group or a substituted or unsubstituted phenyl group.

9. A silver halide color photographic light-sensitive material as claimed in claim 8, wherein the amide is a compound represented by the following formula (SA-1):

(SA-1)

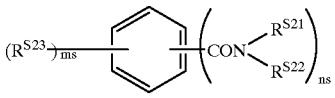

wherein $R^{S21}$ and $R^{S22}$, which may be the same or different, each represents an alkyl group; $R^{S23}$ represents a substituent; ns represents an integer of from 1 to 6; and ms represents an integer of from 0 to 5.

10. A silver halide color photographic light-sensitive material as claimed in claim 5, which further contains a color fading preventing agent, a competing compound, a cyan stain preventing agent or a phenolic cyan coupler.

11. A silver halide color photographic light-sensitive material as claimed in claim 10, wherein the color fading preventing agent is a compound represented by the following formula (ADA):

(ADA)

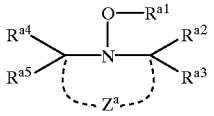

wherein $R^{a1}$ represents a radical (*), an alkyl group, an alkenyl group or an aryl group; $R^{a2}$, $R^{a3}$, $R^{a4}$ and $R^{a5}$, which may be the same or different, each represents a hydrogen atom or an alkyl group; and $Z^a$ represents a non-metallic atomic group necessary to form a 5-membered or 6-membered ring.

12. A silver halide color photographic light-sensitive material as claimed in claim 10, wherein the competing compound is a compound represented by the following formula (ADB):

(ADB)

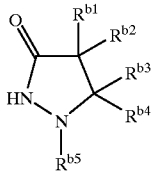

wherein $R^{b1}$, $R^{b2}$, $R^{b3}$ and $R^{b4}$, which may be the same or different, each represents a hydrogen atom, an alkyl group or an aryl group; and $R^{b5}$ represents an aryl group.

13. A silver halide color photographic light-sensitive material as claimed in claim 10, wherein the cyan stain preventing agent is a compound represented by the following formula (ADC), (ADD) or (ADE):

(ADC)

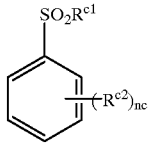

wherein $R^{c1}$ represents a hydrogen atom, a metal atom or an ammonium; $R^{c2}$ represents a substituent; and nc represents an integer of from 1 to 5, (ADD)

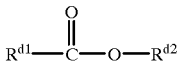

wherein $R^{d1}$ represents an alkyl group, an aryl group, a heterocyclic group, an alkoxy group, an aryloxy group, an alkylamino group or an arylamino group and $R^{d2}$ represents an aryl group, (ADE)

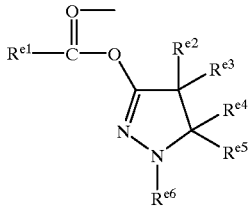

wherein $R^{e1}$ has the same meaning defined for $R^{d1}$ in the formula (ADD); $R^{e2}$, $R^{e3}$, $R^{e4}$ and $R^{e5}$ have the same meanings defined for $R^{b1}$, $R^{b2}$, $R^{b3}$ and $R^{b4}$ in the formula (ADB), respectively; and $R^{e6}$ has the same meaning defined for $R^{b5}$ in the formula (ADB).

14. A silver halide color photographic light-sensitive material as claimed in claim 10, wherein the phenolic cyan coupler is a compound represented by the following formula (ADF):

(ADF)

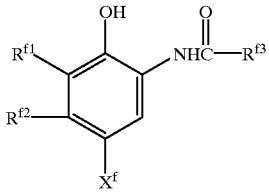

wherein $X^f$ represents a hydrogen atom or an atom or group capable of being released upon a coupling reaction with an oxidation product of an aromatic amine developing agent; $R^{f1}$ and $R^{f2}$, which may be the same or different, each represents a hydrogen atom or a substituent, or $R^{f1}$ and $R^{f2}$ may be combined each other to form a 5-membered or 6-membered ring; and $R^{f3}$ represents an alkyl group, an aryl group, an alkylamino group or an arylamino group.

15. The silver halide color photographic light-sensitive material as claimed in claim 1, wherein the coupler represented by formula (1) is a cyan coupler.

16. A silver halide color photographic light-sensitive material comprising a support having provided thereon at least one hydrophilic colloid layer, wherein the silver halide color photographic light-sensitive material contains a coupler represented by the formula (1) shown below and a non-color forming colorless cyclic imide compound having a diffusion-resistant group:

(1)

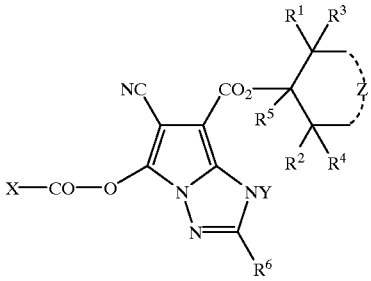

wherein $R^1$ and $R^2$ each represents an alkyl group or an aryl group; $R^3$, $R^4$ and $R^5$ each represents a hydrogen atom, an alkyl group or an aryl group; Z represents a non-metallic atomic group necessary to form a saturated ring; $R^6$ represents a substituent; X represents a heterocyclic group, a substituted amino group or an aryl group; and Y represents a hydrogen atom or a group capable of being released upon color development, wherein the non-color forming colorless cyclic imide compound having a diffusion-resistant group is a compound represented by the following formula (B):

(B)

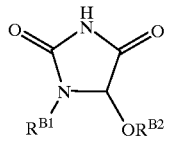

wherein $R^{B1}$ and $R^{B2}$, which may be the same or different, each represents a substituted or unsubstituted alkyl group or a substituted or unsubstituted aryl group and at least one of $R^{B1}$ and $R^{B2}$ is or contains a diffusion-resistant group having from 8 to 22 carbon atoms.

17. A silver halide color photographic light-sensitive material comprising a support having provided thereon at least one hydrophilic colloid layer, wherein the silver halide color photographic light-sensitive material contains a coupler represented by the formula (1) shown below and a non-color forming colorless cyclic imide compound having a diffusion-resistant group:

(1)

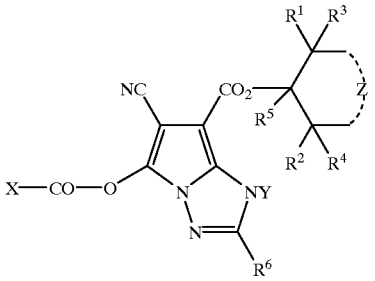

wherein $R^1$ and $R^2$ each represents an alkyl group or an aryl group; $R^3$, $R^4$ and $R^5$ each represents a hydrogen atom, an alkyl group or an aryl group; Z represents a non-metallic atomic group necessary to form a saturated ring; $R^6$ represents a substituent; X represents a heterocyclic group, a substituted amino group or an aryl group; and Y represents a hydrogen atom or a group capable of being released upon color development, said material further contains a non-color forming colorless carboxylic acid having a diffusion-resistant group or a salt thereof, wherein the non-color forming colorless carboxylic acid having a diffusion-resistant group or a salt thereof is a compound represented by the following formula (C):

(C)

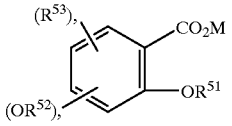

wherein $R^{51}$ and $R^{52}$ each represents a substituted or unsubstituted alkyl group, a substituted or unsubstituted aryl group, a substituted or unsubstituted acyl group, a substituted or unsubstituted carbamoyl group or a substituted or unsubstituted alkoxycarbonyl group; $R^{53}$ represents a halogen atom, a substituted or unsubstituted alkyl group, a substituted or unsubstituted aryl group, a substituted or unsubstituted acyl group, a substituted or unsubstituted carbamoyl group, a substituted or unsubstituted alkoxycarbonyl group, a substituted or unsubstituted sulfonyl group or a substituted or unsubstituted sulfamoyl group; at least one of $R^{51}$, $R^{52}$ and $R^{53}$ is or contains as a substituent a diffusion-resistant group having from 8 to 22 carbon atoms; M represents a hydrogen atom, a metal atom or an ammonium; q represents an integer of from 0 to 2; r represents an integer of from 0 to 4; and provided that the sum of q and r is 4 or less.

18. A silver halide color photographic light-sensitive material comprising a support having provided thereon at least one hydrophilic colloid layer, wherein the silver halide color photographic light-sensitive material contains a coupler represented by the formula (1) shown below and a non-color forming colorless cyclic imide compound having a diffusion-resistant group:

(1)

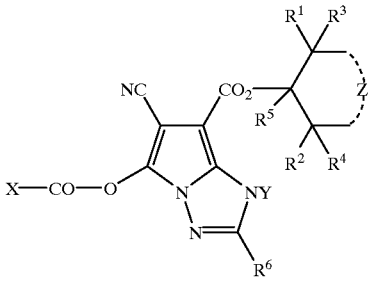

wherein $R^1$ and $R^2$ each represents an alkyl group or an aryl group; $R^3$, $R^4$ and $R^5$ each represents a hydrogen atom, an alkyl group or an aryl group; Z represents a non-metallic atomic group necessary to form a saturated ring; $R^6$ represents a substituent; X represents a heterocyclic group, a substituted amino group or an aryl group; and Y represents a hydrogen atom or a group capable of being released upon color development, wherein the coupler represented by the formula (1) and the non-color forming colorless cyclic imide compound having a diffusion-resistant group are present in a different hydrophilic colloid layer of the photographic light-sensitive material.

19. A silver halide color photographic light-sensitive material comprising a support having provided thereon at least one hydrophilic colloid layer, wherein at least one of the hydrophilic colloid layers contains a non-color forming colorless compound having a diffusion-resistant group represented by the following formula (A):

(A)

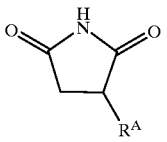

wherein $R^A$ represents a substituted or unsubstituted alkenyl group, a substituted or unsubstituted alkoxy group or a substituted or unsubstituted aryloxy group and $R^A$ is or contains a diffusion-resistant group having from 8 to 22 carbon atoms.

* * * * *